US008899167B2

(12) United States Patent
Wiggins et al.

(10) Patent No.: US 8,899,167 B2
(45) Date of Patent: Dec. 2, 2014

(54) LINEAR CUTTING ASSEMBLY, LINEAR CUTTING SYSTEM, AND NET PENETRATING METHOD

(75) Inventors: James Wiggins, Thurmont, MD (US); Walter Allensworth, Poolesville, MD (US); Conrad Zeglin, Rockville, MD (US); Chris Norkoski, Baltimore, MD (US)

(73) Assignee: Adaptive Methods, Inc., Rockville, MD (US)

( * ) Notice: Subject to any disclaimer, the term of this patent is extended or adjusted under 35 U.S.C. 154(b) by 58 days.

(21) Appl. No.: 13/403,491

(22) Filed: Feb. 23, 2012

(65) Prior Publication Data

US 2012/0210836 A1 Aug. 23, 2012

Related U.S. Application Data

(60) Provisional application No. 61/445,847, filed on Feb. 23, 2011.

(51) Int. Cl.

| | |
|---|---|
| ***B63G 9/00*** | (2006.01) |
| ***B26D 1/11*** | (2006.01) |
| ***B26D 1/00*** | (2006.01) |
| ***B63C 11/52*** | (2006.01) |
| *B63G 7/00* | (2006.01) |
| *B63G 8/00* | (2006.01) |

(52) U.S. Cl.

CPC .. *B26D 1/11* (2013.01); *B63G 9/00* (2013.01); *B26D 1/0006* (2013.01); *B26D 2001/006* (2013.01); *B26D 2001/0066* (2013.01); *B63C 11/52* (2013.01); *B63G 2007/005* (2013.01); *B63G 2008/002* (2013.01)

USPC ..... 114/221 A; 114/20.3; 114/221 R

(58) Field of Classification Search

CPC ..... B63G 8/29; B63G 7/04

USPC ..... 114/221 A, 20.3, 221 R; 30/169, 392, 30/393, 209; 83/751

See application file for complete search history.

(56) References Cited

U.S. PATENT DOCUMENTS

| | | | | | |
|---|---|---|---|---|---|
| 893,173 | A | * | 7/1908 | Kunze | 114/221 A |
| 1,247,111 | A | * | 11/1917 | Helmberger | 114/221 A |
| 1,278,005 | A | * | 9/1918 | Peterson | 114/221 A |
| 1,931,772 | A | * | 10/1933 | Simpson et al. | 114/221 A |
| 4,722,667 | A | | 2/1988 | Rikhy et al. | |
| 4,954,108 | A | | 9/1990 | Govan | |
| 5,191,819 | A | | 3/1993 | Hoshi | |

* cited by examiner

*Primary Examiner* — Jonathan C Weber

(74) *Attorney, Agent, or Firm* — Dickstein Shapiro LLP

(57) ABSTRACT

The problem of penetrating through nets and other objects is solved by cutting the object using a linear cutting assembly having a linear cutter arm that moves in an arc and pivots about an attachment point. The object is cut by a severing action caused by a moveable blade of the linear cutting arm moving back and forth across a stationary blade of the linear cutter arm. An underwater vehicle modified to incorporate an embodiment of the linear cutting assembly can cut a sufficiently large opening in the object to allow the vehicle to pass through.

33 Claims, 22 Drawing Sheets

LINEAR CUTTING ASSEMBLY, LINEAR CUTTING SYSTEM, AND NET PENETRATING METHOD

This application claims priority under 35 U.S.C. §119(e) to Provisional Application No. 61/445,847, filed on Feb. 23, 2011, which is incorporated herein by reference.

FIELD OF THE INVENTION

The invention relates generally to a cutting assembly, and in particular to a system, method, and apparatus for cutting nets and other objects.

BACKGROUND

Nets of various types, materials, sizes and shapes such as, gill nets, purse nets, trawl nets, lift nets, drift nets and aquaculture nets, among others, may cover large areas of the ocean and create physical barriers to moving marine vessels and underwater vehicles. Marine vessels and underwater vehicles can encounter these nets and others in a variety of orientations and tensions. Nets can be anchored and tightly strung, be loose and compliant, or float with weights distributed on the bottom. The use of fishing nets and other objects in water bodies present a significant obstacle to marine vessels and underwater vehicles, especially in littoral zones where fishing activity is concentrated.

Unmanned underwater vehicles (UUVs) have contributed greatly to the gathering of information in harbors and littoral waters where other underwater vehicles such as submarines cannot travel or may be easily detected. For example, UUVs can carry out critical missions in the areas of intelligence, surveillance, reconnaissance, mine countermeasures, tactical oceanography, navigation and anti-submarine warfare. Mission performances, however, have been hindered by a UUV's inability to penetrate through fishing nets and other objects while traveling underwater.

Presently, UUV mission areas are scanned for fishing nets and other objects. Mission routes are selected so as to minimize the probability of encountering objects even though the selected route may not be the shortest or the most desired route. Yet, UUVs may be called upon during mission critical situations to penetrate waters in which there is a high probability of encountering fishing nets and other objects. In these situations, a UUV may be forced to stop and maneuver around obstacles encountered during its mission. Even the smallest hull protrusions, such as the control fins, sonar pods and antenna masts of a UUV, may get entangled in a fishing net. Once entangled, divers may be required to retrieve the UUV and cause significant operation delay. Operation failure may result if the UUV is not retrievable or lost altogether.

Accordingly, there is a need and desire for an apparatus, system and method for easily and quickly penetrating through nets and other objects.

DETAILED DESCRIPTION OF THE INVENTION

Figure 1:
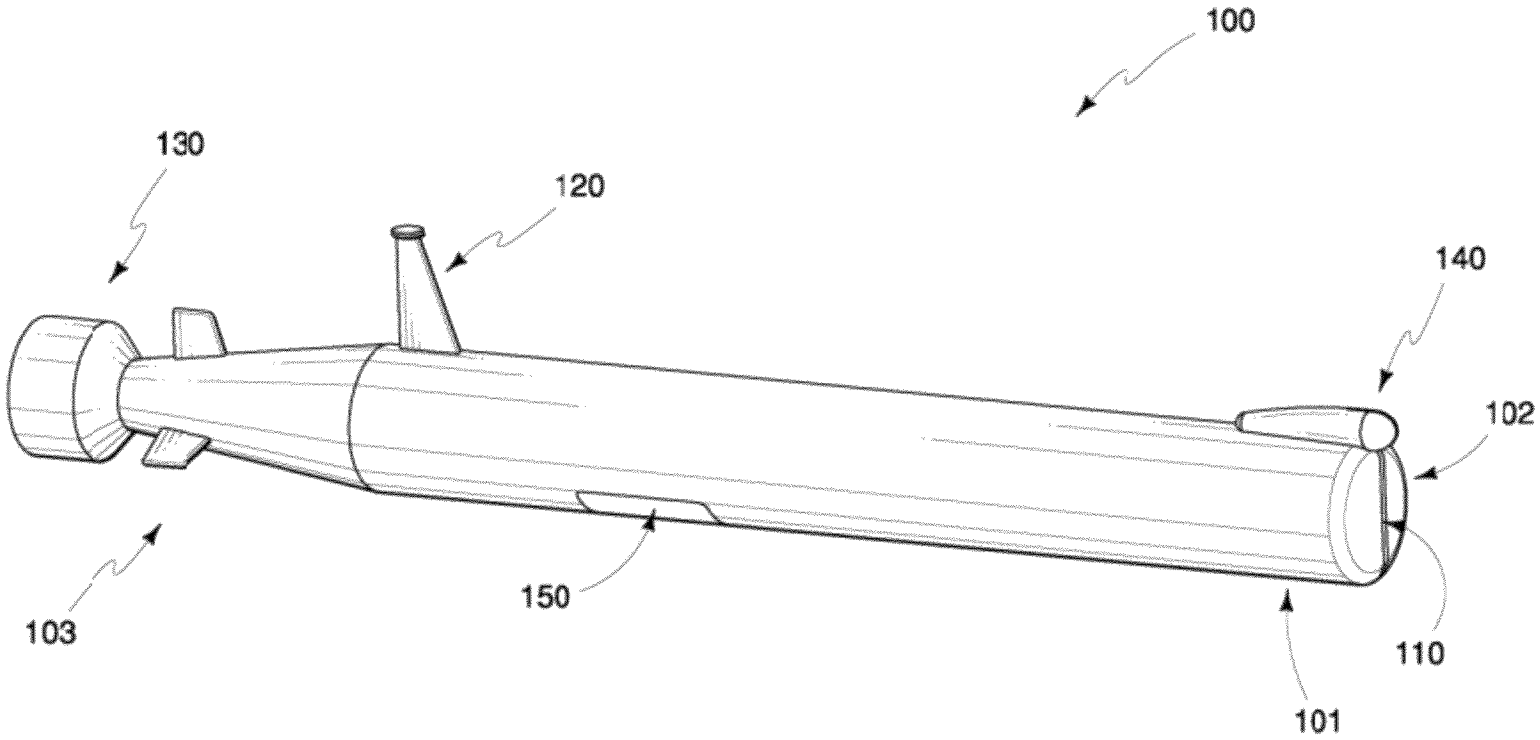
FIG. 1 is a diagram of a UUV system in accordance with an embodiment described herein.

In the following detailed description, reference is made to the accompanying drawings, which form a part hereof and illustrate specific embodiments that may be practiced. In the drawings, like reference numerals describe substantially similar components throughout the several views. These embodiments are described in sufficient detail to enable those skilled in the art to practice them, and it is to be understood that structural and logical changes may be made. Sequences of steps are not limited to those set forth herein and may be changed or reordered, with the exception of steps necessarily occurring in a certain order.

The problem of penetrating through nets and other objects is solved by cutting the object using a linear cutting assembly having a linear cutter arm that moves in an arc and pivots about an attachment point. The net is cut by a severing action caused by a moveable blade of the linear cutting arm moving back and forth across a stationary blade of the linear cutter arm. A linear cutting assembly that is attached to an underwater vehicle will cut a sufficiently large opening in the net to allow the vehicle to pass through.

Disclosed embodiments include a system and method for penetrating through fishing nets and other objects, as well as various apparatuses, including a linear cutting assembly, for use in this system. Embodiments of the linear cutting assembly include a linear cutter arm with a moveable blade having teeth that slide back and forth against the teeth of a stationary blade.

The invention may be used to particular advantage in the context of underwater vehicles traveling in areas with high fishing activity. Therefore, the following example embodiments are disclosed in the context of UUV systems. However, it will be appreciated that those skilled in the art will be able to incorporate the invention into numerous other alternative systems that, while not shown or described herein, embody the principles of the invention.

Figure 2:
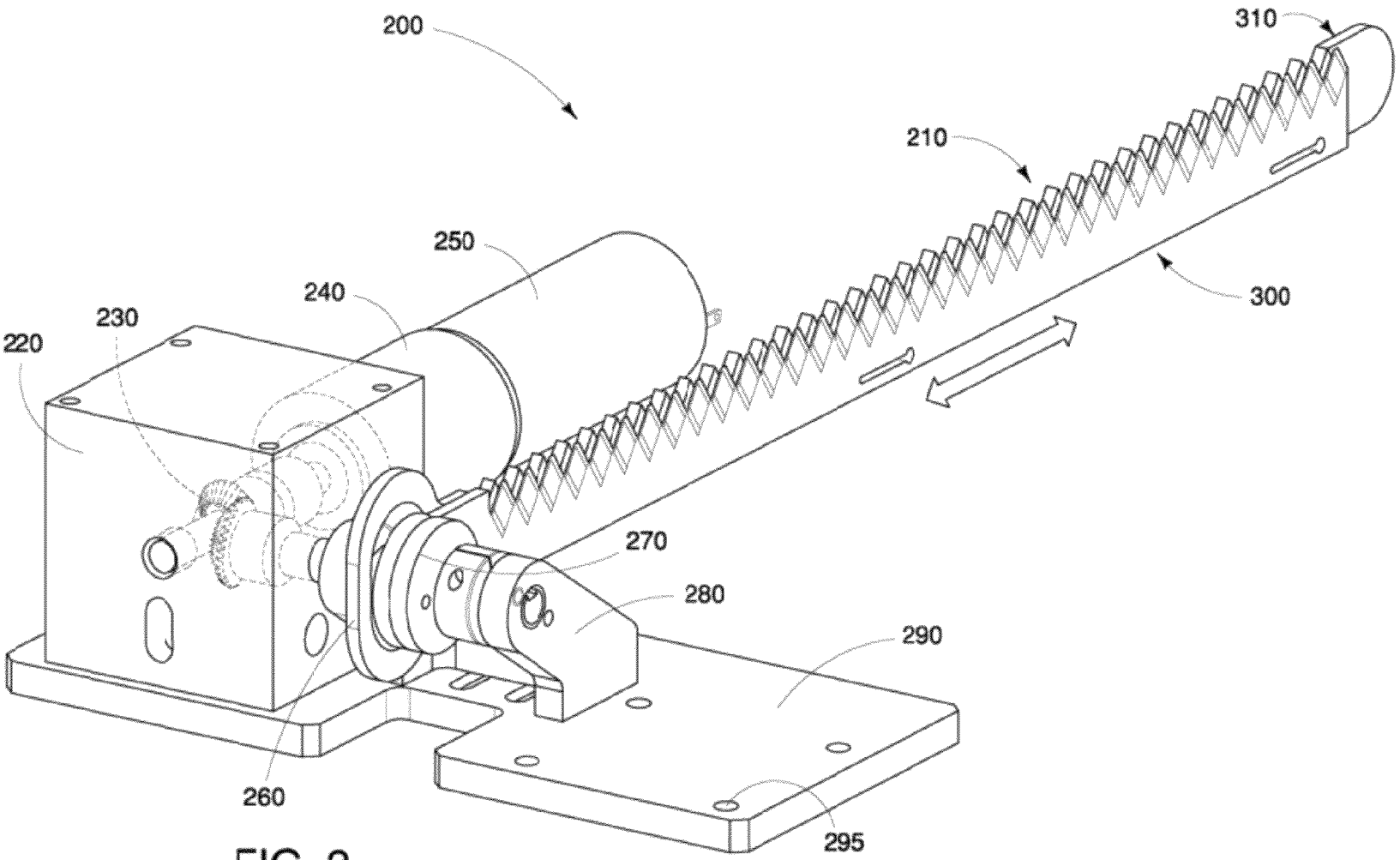
FIG. 2 is a profile view of a linear cutting assembly in accordance with an embodiment described herein.

FIG. 1 shows a UUV system 100 in accordance with an embodiment described herein. UUV 100 has two parallel spaced cutter guides 110 at the forward end 101 for keeping a net or object away from the front face 102 of the UUV 100. At the aft end 103, UUV 100 has a propulsor 130 and hull protrusion 120. Attached on the outside of the forward end 101 of UUV 100 is a pod 140 containing a linear cutting assembly 200 (FIG. 2). A control container 150 containing a control processor for controlling the UUV 100 and the linear cutting assembly 200 functions, a memory for storing control software and an I/O processor is located in the rear bottom of UUV 100, although it shall be appreciated that the control container 150 can be located anywhere in UUV 100. The control processor is the main processor for UUV 100 and will run the control software for the linear cutting assembly 200. Because the linear cutting assembly 200 is contained in the pod 140 and the pod 140 is attached externally to the UUV 100, the linear cutting assembly 200 can be easily installed, removed, and repaired at sea. The pod 140 is lightweight and has minimal effect on the static and dynamic balance of the UUV 100.

FIG. 2 is a profile view of an exemplary linear cutting assembly 200 that can be housed in the pod 140 of UUV 100. Linear cutting assembly 200 includes a linear cutter arm 210, a gear housing 220 containing bevel gears 230, a gear box 240 integrated with a DC motor 250, a cam assembly 260, a clutch assembly 270 and a frame structure 280 attached to a base plate 290. The base plate 290 is attached to the inside bottom surface of the pod 140 using fasteners 295 or other suitable means. The DC motor 250 is mated with a gearhead. The integrated DC motor 250 produces a predetermined amount of power such as, for example about 120 watts of motor power, based on the expected UUV power source. Alternatively, it will be appreciated that other suitable gearing concepts, such as, a worm gear system, a planetary gear set, among others, can be incorporated to drive the cutting assembly 200.

Figure 3:
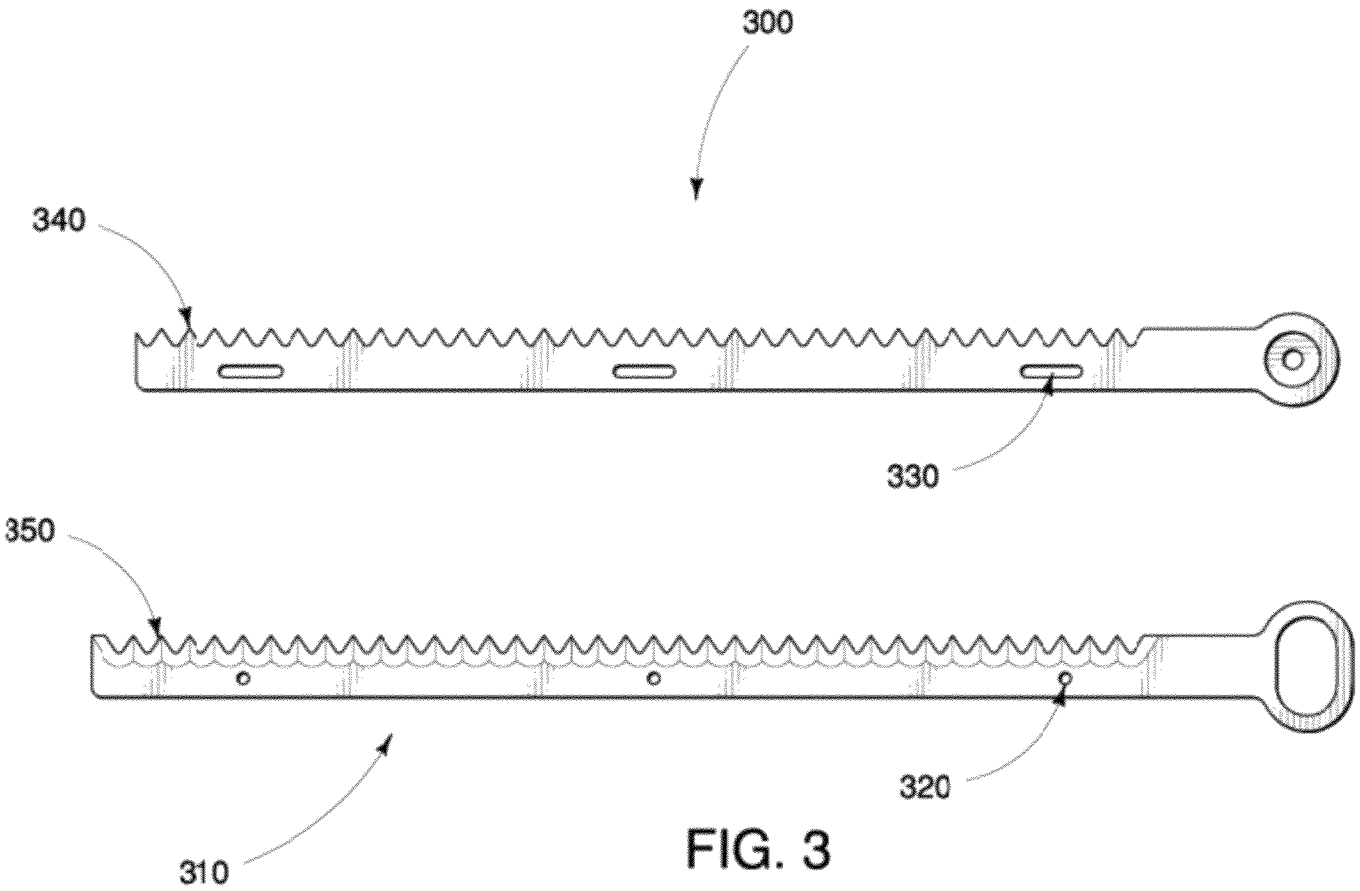
FIG. 3 is a side view of a stationary blade and a moveable blade of a linear cutter arm in accordance with an embodiment described herein.

FIG. 3 shows a side profile of the linear cutter arm's 210 stationary blade 300 separated from its moveable blade 310. The stationary blade 300 is located parallel to, and preferably in contact with, the moveable blade 310 when the cutter arm 210 is assembled as shown in FIG. 2. A peg 320 and slot 330 can be used to ensure that the blades 300 and 310 remain in contact and in alignment over the entire cutting length and allow the blades 300 and 310 to slide linearly between them. The moveable blade 310 will slice through the net or object as it moves back and forth across the stationary blade 300. A UUV 100 such as, for example, a vehicle having a 12.75 inch diameter, preferably has stationary 300 and moveable 310 blades that are approximately 14 inches long.

The reciprocating teeth 340 and 350 of the stationary 300 and moveable 310 blades, respectively, are effective at cutting in both directions. FIG. 3 shows the teeth 340 and 350 are triangular shaped and each tooth is located equidistant from each other. The teeth must be sized correctly to effectively engage the net. If the teeth are too wide, they will not fit into the holes of smaller-meshed nets. If the teeth are too short, they will not provide an adequately long cutting surface for the floating teeth to move against. As tooth length increases, however, it becomes more susceptible to damage. Preferably, the teeth 340 and 350 have peak-to-peak spacing of approximately 0.5 inch apart and have angles of approximately 50 degrees on both sides. It will be appreciated that the tooth angle, length, tip and base radii, and arm thickness can vary based on the size of the opening to be cut and performance parameters, such as the length of cutting time.

The blades 300 and 310 and teeth 340 and 350 may be manufactured from stainless steel or any other anti-corrosive material, such as, but not limited to plastic, titanium, carbon fiber and coated steel. A hardened surface coating, such as, titanium-nitride, or a low-friction material may be applied to the teeth to increase wear resistance and reduce power usage.

Figure 4B:
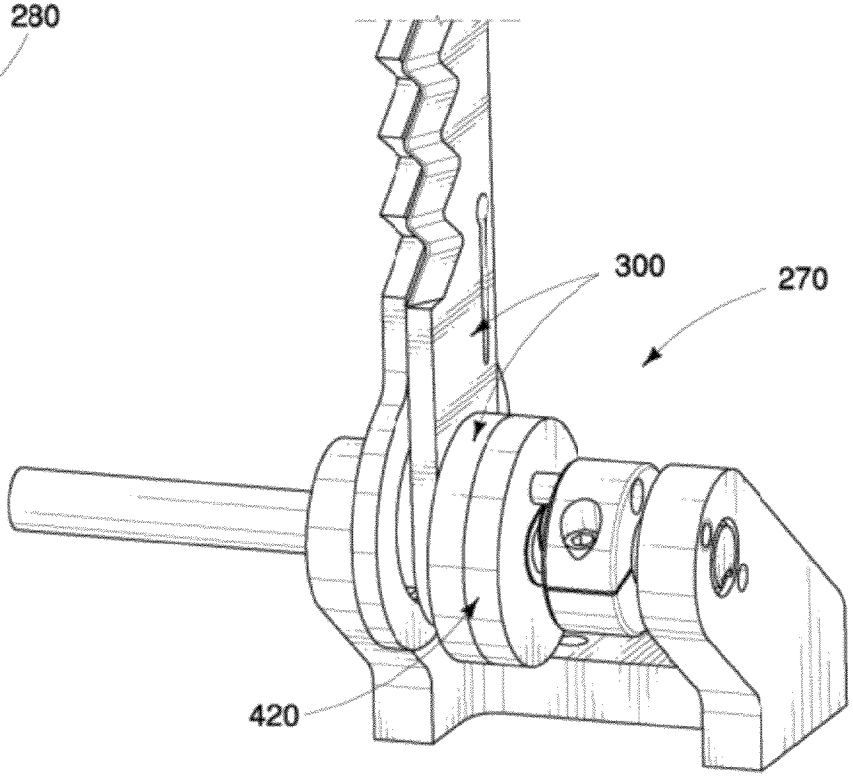
FIG. 4B is a profile view of a clutch assembly of a linear cutting assembly in accordance with an embodiment described herein.
Figure 4A:
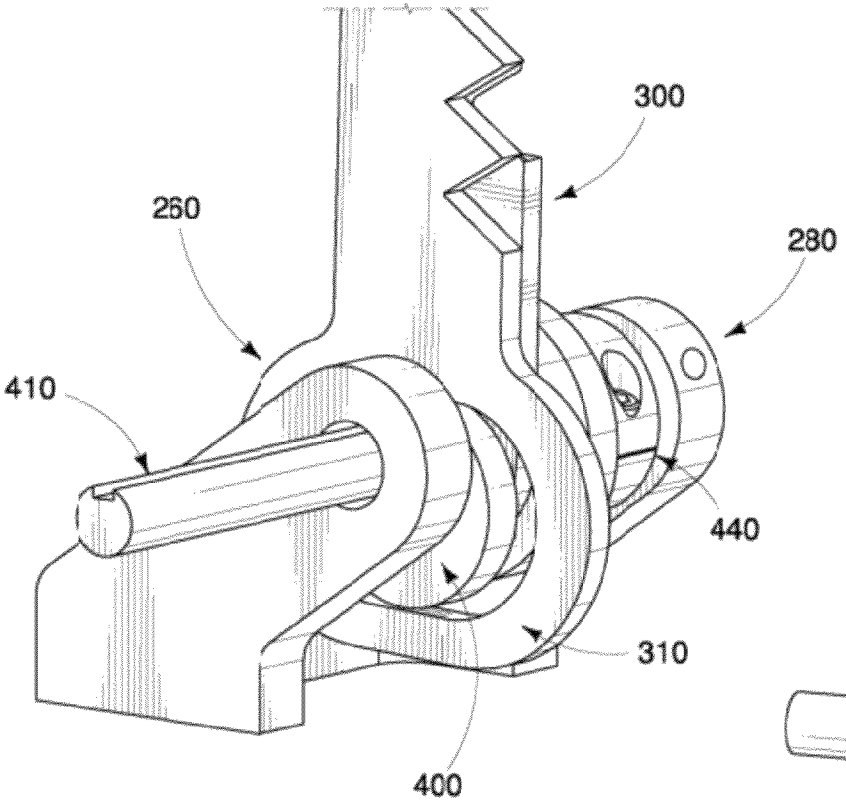
FIG. 4A is a profile view of a cam assembly of a linear cutting assembly in accordance with an embodiment described herein.
Figure 4C:
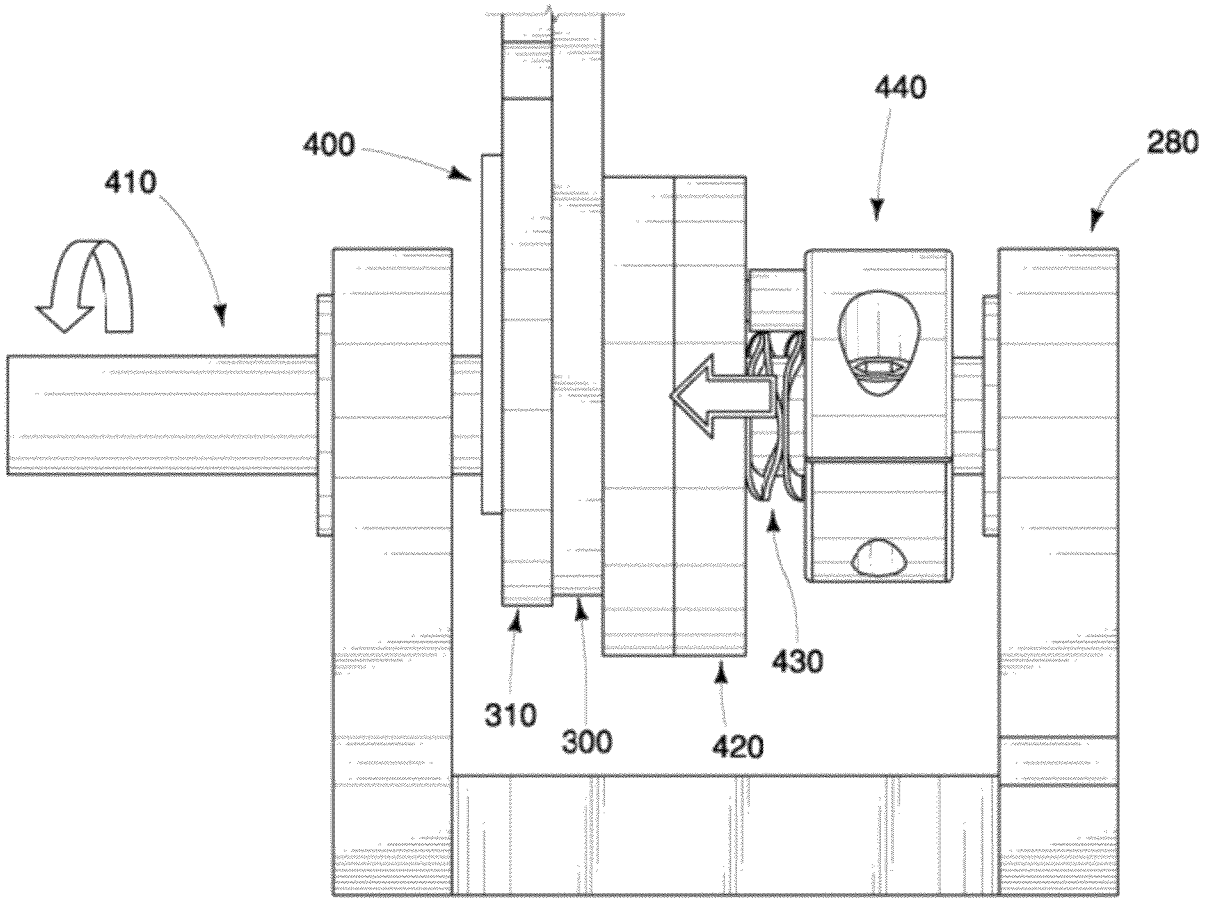
FIG. 4C is a front view of a portion of the linear cutting assembly in accordance with an embodiment described herein.

FIG. 4A is a profile view of the cam assembly 260 of the linear cutting assembly 200. The cam assembly 260 transforms the rotating motion of the offset cam 400 into linear motion of the moveable blade 310 to allow the moveable blade 310 to move linearly back and forth along the longitude of the stationary blade 300. The offset cam 400 and shaft collar 440 are fixed to the drive shaft 410 and rotated by the gears 230 and motor 250 (FIG. 2). One advantage of the disclosed embodiment is the design of the mechanical clutch assembly 270, as shown in FIG. 4B, and the use of the single motor 250 to control the deployment and retrieval motions of the linear cutter arm 210 and the linear motion of the moveable blade 310. As illustrated in FIG. 4C, the springs 430 push the clutch plate 420 axially across the rotating shaft 410 to provide the necessary force to drive the linear cutter arm 210 through the net. When the arm 210 meets sufficient resistance, its forward motion will slow and the clutch 270 will slip, providing more time to cut through the net. It will be appreciated by those skilled in the art that the clutch assembly 270 may need to be geared to allow better net engagement.

Figure 17:
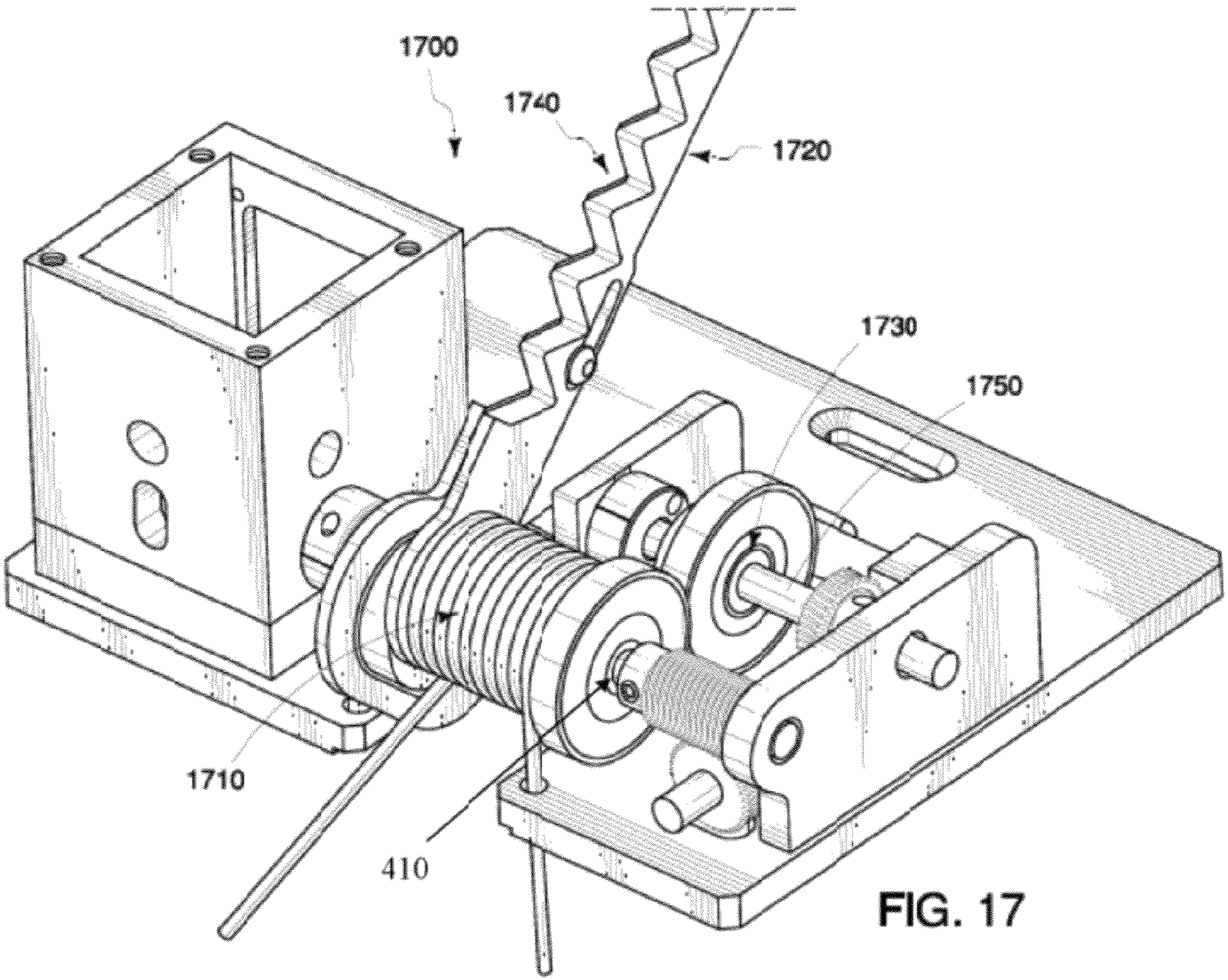
FIGS. 17 and 18 illustrate a profile view and a top-down view respectively of a linear cutting assembly in accordance with another embodiment described herein.
Figure 18:
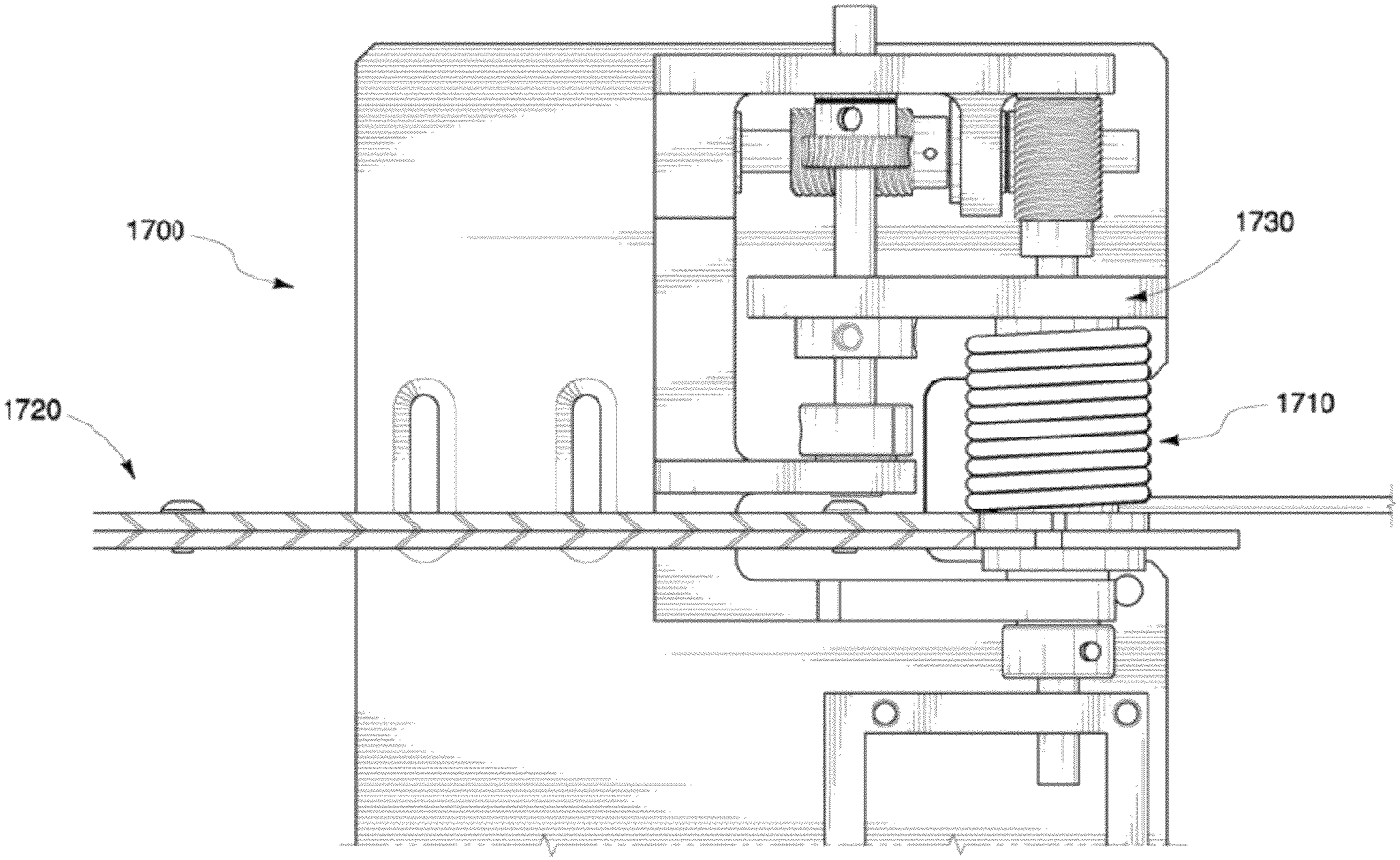

FIGS. 17 and 18 illustrate a profile view and a top-down view respectively of another exemplary linear cutting assembly embodiment 1700. The differences between linear cutting assemblies 200 and 1700 are explained below. Linear cutting assembly 1700 includes a torsion spring 1710 to drive the linear cutter arm 1720 forward independent of the front shaft 410 and a geared one-way bearing 1730 to retract the linear cutter arm 1720. The one-way bearing 1730 locks to the rear shaft 1750 when the motor is reversed to retract the linear cutter arm 1720.

Figure 21:
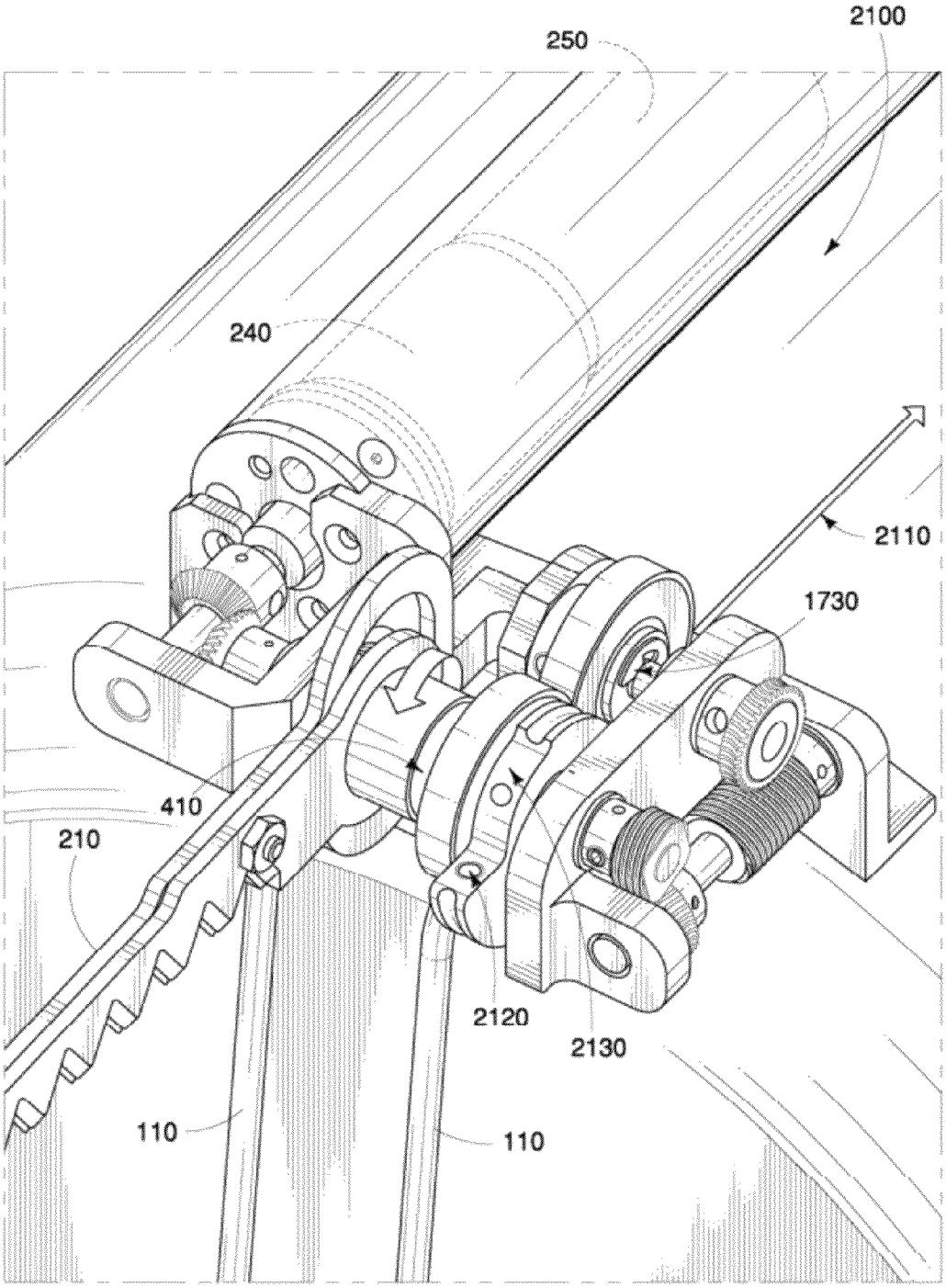
FIG. 21 is a simplified diagram of a linear cutting assembly in accordance with an alternate embodiment described herein.

FIG. 21 is a simplified diagram of a linear cutting assembly 2100 incorporating a linear cutter arm 210, in accordance with an alternate embodiment of the present invention. This embodiment is similar to that shown in FIGS. 17-18, however instead of relying on a torsion spring, the linear cutting assembly 2100 utilizes a linear spring 2110 to rotate the linear cutter arm 210 forward. The one-way bearing 1730 allows the motor 250 to retract the linear cutter arm 210 and stores energy in the linear spring 2110. The linear spring 2110 is mounted to the front shaft 410 at the spring mounting point 2120 on the cam assembly 2130. This embodiment has the advantage of allowing all motor power to be used to oscillate the blades 300 and 310 of the linear cutter arm 210 back and forth to cut through the object.

Figure 19:
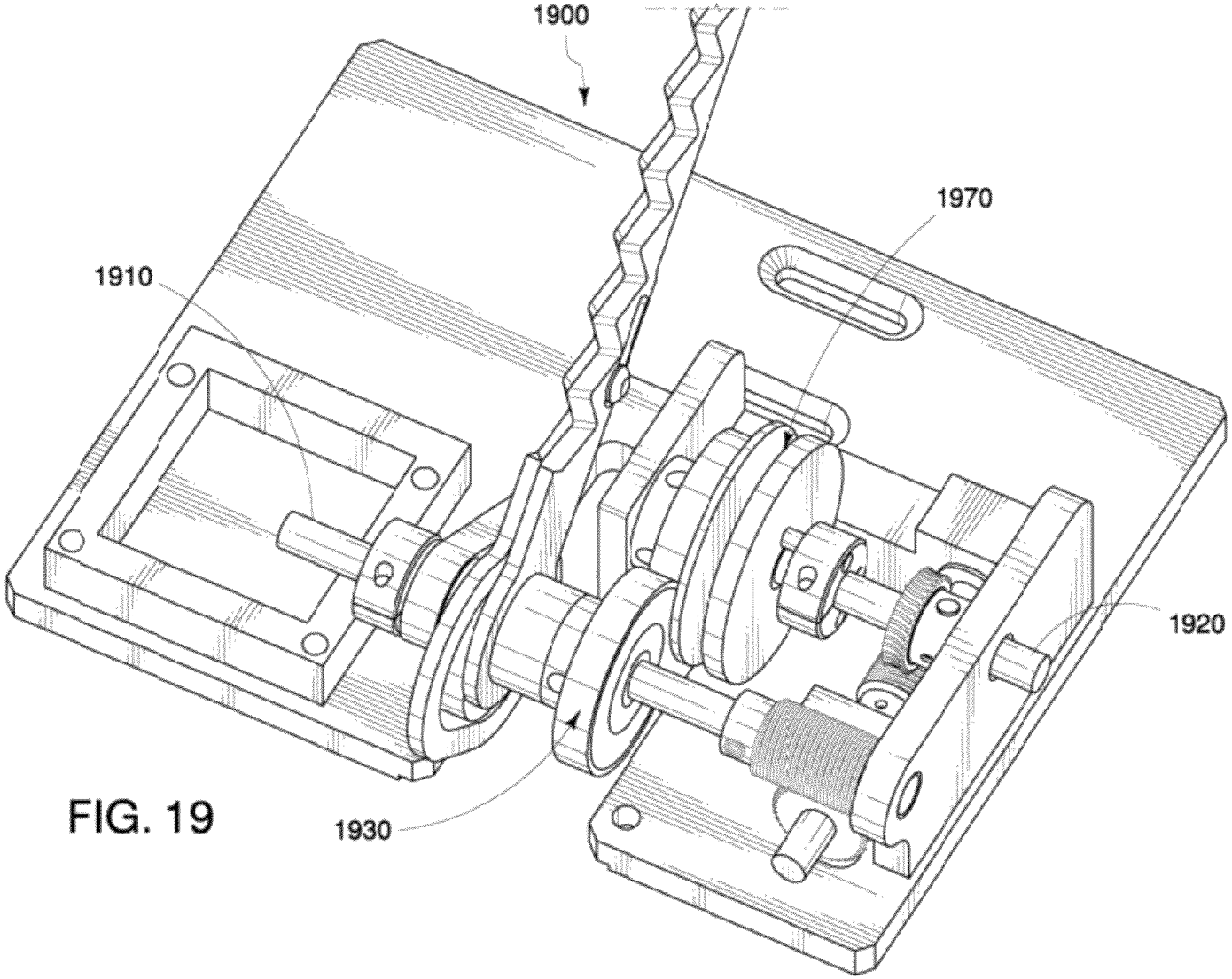
FIGS. 19 and 20 illustrate a profile view and a top-down view respectively of a linear cutting assembly in accordance with another embodiment described herein.
Figure 20:
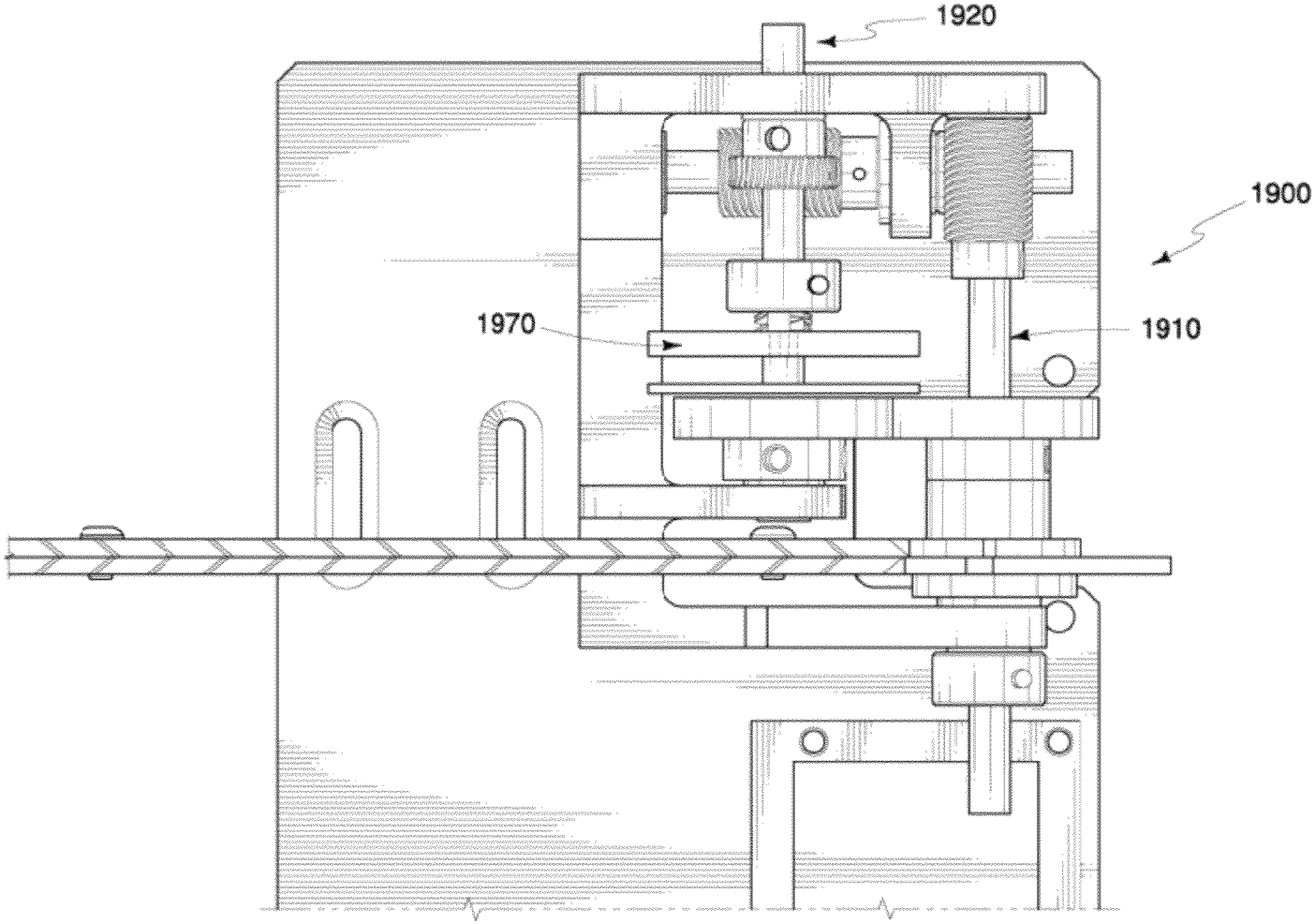

Another exemplary linear cutting assembly embodiment 1900 that can be housed in the pod 140 of UUV 100 has a reduced RPM clutch assembly 1970 as illustrated in FIGS. 19 and 20. The differences between linear cutting assembly embodiments 200, 1700 and 1900 are explained below. Linear cutting assembly 1900 has a front shaft 1910 and a rear shaft 1920. The offset cam 1930 is fixed to the front shaft 1910 and rotated by gears and a motor similar to the gears 230 and motor 250 shown in FIG. 2. In contrast to the clutch assembly 270, the clutch assembly 1970 is located on the rear shaft 1920 and geared down to minimize slippage, preferably a 100:1 gear reduction. The clutch assembly 1970 operates at 1/1000th of the motor speed or approximately 8 RPM.

Figure 5A:
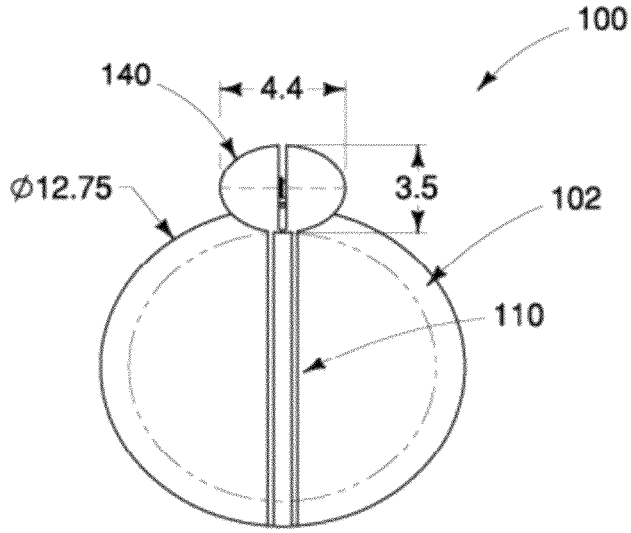
FIG. 5A is a front view of the UUV system of FIG. 1.
Figure 5B:
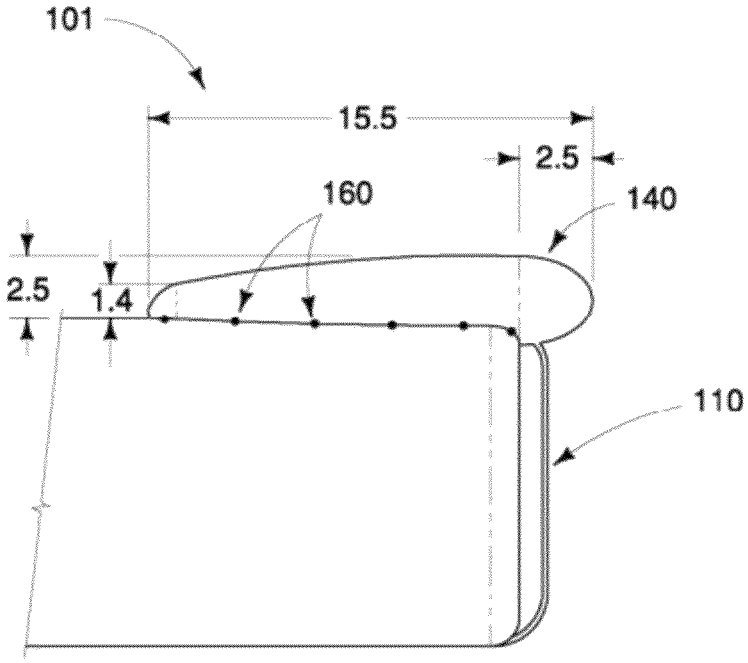
FIG. 5B is a side view of a portion of the UUV system of FIG. 1.

FIG. 5A is a front view of the UUV system 100 shown in FIG. 1. The maximum cross section of the pod 140 is an ellipse. As shown in the present embodiment, the pod has a major axis of approximately 4.4 inches and a minor axis of approximately 3.5 inches. However, any sized pod can be used. The pod 140 containing the linear cutting assembly 200 has an hydrodynamic shape as shown in FIGS. 5A and 5B to minimize drag as UUV 100 moves underwater and to minimize the power required for the linear cutting assembly 200 to penetrate through the net. A UUV 100 for example has a pod 140 that is approximately 15.5 inches long and that gradually tapers toward the aft end 103 (FIG. 1) of the vehicle 100. Again, the size of the pod can vary. A preferred height of the pod 140 above the exterior of the vehicle 100 is approximately 2.5 inches as shown in FIG. 5B. Minimizing the frontal area and overall surface area of the pod 140 will reduce hydrodynamic drag and help maximize mission duration. Syntactic foam, for example, can be placed inside the pod 140 to balance the linear cutting assembly 200 and add structural support to the pod 140. The pod 140 can be attached to the UUV 100 through the use of fasteners mounted to hull attachment points 160. Alternatively, the pod 140 can be secured to the hull with one or more straps (not shown) or by other conventionally known fasteners.

Figure 7A:
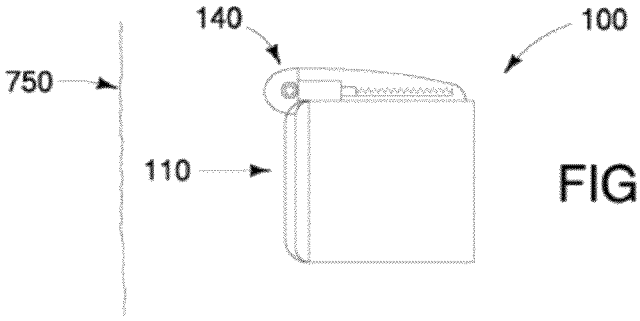
FIGS. 7A-7D respectively illustrate a linear cutting assembly in a 0 degree, a 45 degree, a 135 degree and a 270 degree rotating motion in accordance with an embodiment described herein.

FIGS. 5A and 5B show two parallel spaced cutter guides 110 on the front face 102 of UUV 100. The cutter guides 110 are spaced apart just enough for the cutter arm 210 to pass in between the guides 110, as shown in FIG. 7D. When the UUV 100 encounters a fishing net or other object, its forward end 101 may become entangled in the net and cause the net to contact the two guides 110. The cutter guides 110 prevent the net from contacting the front face 102 as the UUV 100 continues to move forward and the net is tightly stretched across the cutter guides 110. The inventors have discovered that keeping the net away from the front face 102 of the UUV 100 ensures that the cutter arm 210 can cut through the net quickly. In accordance with an advantageous feature of the disclosed embodiment, the cutter guides 110 are acoustically transparent so they will not interfere with UUV frontal sensors and equipment, such as, the Forward Looking Sonar (FLS), retrieval hardware, among others. It will be appreciated by those skilled in the art that variations on the cutter guides 110 can include various shapes allowing for easier cutting through the object. Additional cutter guides may be placed on the top and bottom surfaces of UUV 100 to allow for the placement of UUV systems such as automatic docking systems. Alternatively, a slit opening (not shown) can be formed in the front face 102 of the UUV 100. The slit opening provides a recessed space for the cutter arm 210 as it cuts through the fishing net or other object.

In accordance with another advantageous feature of the disclosed embodiment, the only modifications to UUV 100 required is a power connection from the UUV 100 to the linear cutting assembly 200 and the installation of control software in the memory module of the UUV 100 to be executed by the onboard control processor. The power connection from the UUV 100 to the linear cutting assembly 200 can use a right angle watertight bulkhead connector. The control software will analyze UUV speed and propulsor data to determine if a net or object has been encountered and implement the steps shown in FIG. 6 below to control the arming, deployment and retrieval of the linear cutter arm 210. Alternatively, it shall be appreciated that the linear cutting assembly 200 can be self-contained with its own integrated power supply, memory module and control processor for running the control software.

Figure 6:
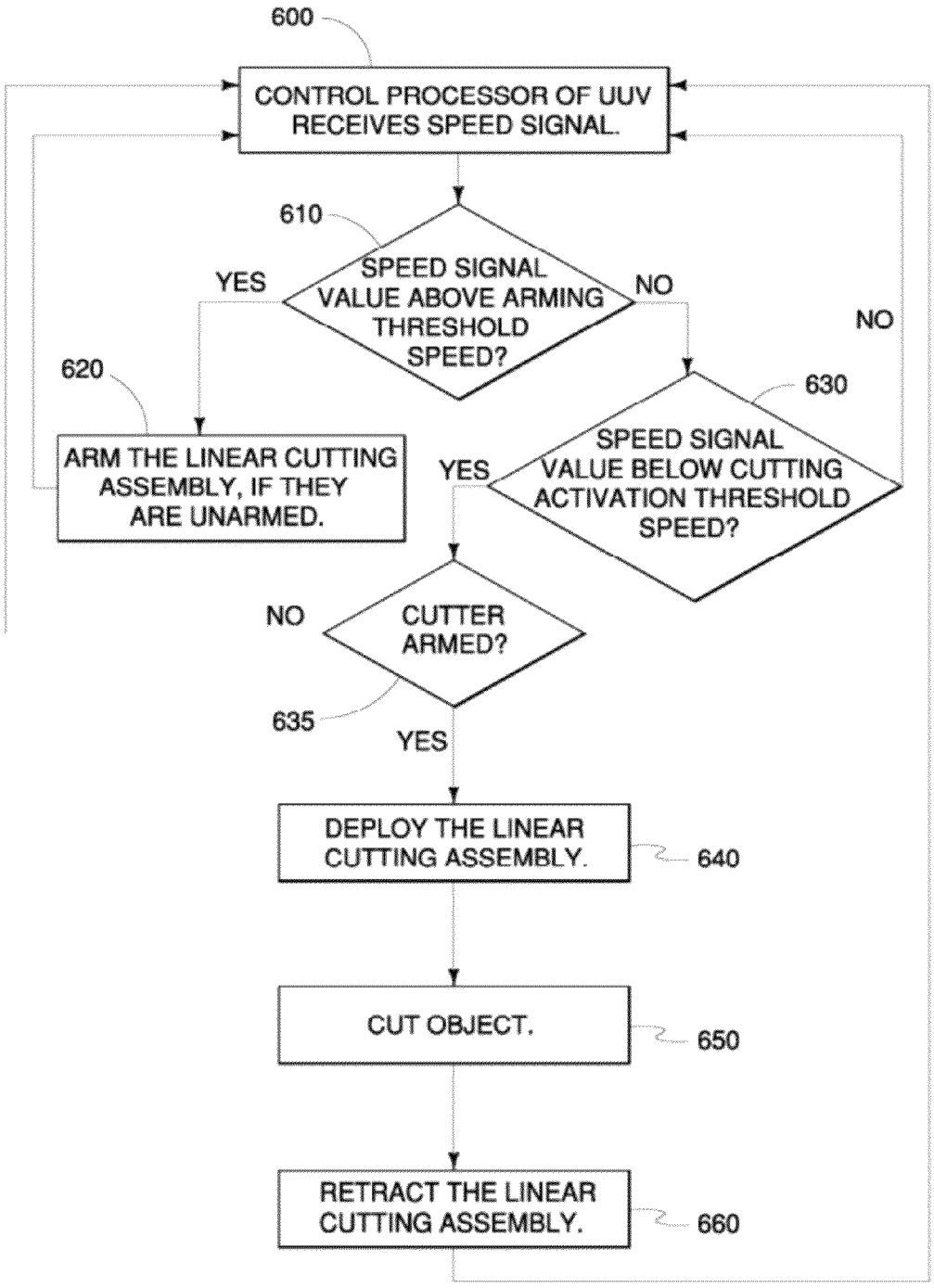
FIG. 6 is a flow chart of a method for penetrating through a net using a linear cutting assembly in accordance with an embodiment described herein.

FIG. 6 is a flow chart of a method for penetrating through a net or object using the linear cutter assembly 200. At step 600, the control processor of UUV 100 receives a speed signal from UUV 100 at predetermined time intervals. It should be appreciated by those skilled in the art that the speed signal can be generated by UUV 100 using any known method of speed detection. Speed sensors such as a pressure switch or a paddle wheel can be used to measure the speed at which UUV 100 is traveling.

According to one embodiment, UUV 100 is configured to travel at 3.0 knots when carrying out a mission. In this embodiment, an arming threshold speed can be set at any speed between 0 and 3 knots, preferably 2.5 knots, for the purpose of determining when to arm the linear cutting assembly 200. Upon receiving a speed signal from UUV 100, at step 610, the control processor determines whether UUV 100 is traveling at a speed above the arming threshold speed. Linear cutting assembly 200 remains disarmed until the UUV 100 reaches the arming threshold speed of 2.5 knots. If the speed signal value is above the arming threshold speed, the control processor sends a control signal to arm the linear cutting assembly 200 at step 620, if it is not already armed. FIG. 7A illustrates the linear cutting assembly 200 in an armed state with the linear cutter arm 210 located inside the pod 140 and at a 0 degree angle with respect to the length of UUV 100. The method returns to step 600 to wait for the next speed signal from the UUV 100. It should also be appreciated that other methods besides speed detection can be used to determine when to arm the UUV 100. For example, the linear cutting assembly 200 can remain disarmed until the UUV 100 reaches a predetermined depth, such as 10 feet underwater. A pressure sensing switch or other devices and methods can be used to detect the depth of the UUV 100. Furthermore, other embodiments can show different speed thresholds as well as travel speeds for the UUV.

A cutting activation threshold speed can be set for the purpose of determining when to deploy the linear cutting assembly 200. It should be appreciated by those skilled in the art that UUV 100 can employ any known method of object detection. The same speed sensor used by UUV 100 to measure its speed can also be used for object detection. For instance, when UUV 100 comes into contact with an obstruction, its speed will decrease. Speed changes can be measured and provided to the control processor at predetermined time intervals such as, for example, every 5 seconds. At step 630, the control processor determines whether UUV 100 is traveling at a speed below the cutting activation threshold speed of 2.0 knots, for example.

If UUV 100 is traveling at a speed below the cutting activation threshold speed, the control processor determines whether the linear cutting assembly 200 is armed at step 635. The control processor sends a control signal to deploy the linear cutter arm 210 at step 640 if the linear cutting assembly 200 is armed and power is delivered to the motor 250 (FIG. 2) of the linear cutting assembly 200. While speed detection is one way of indirectly detecting an object obstructing the path of the UUV 100, it should also be appreciated that other methods and devices such as, for example, a contact switch or a high frequency sonar can be used for object detection.

Figure 7B:
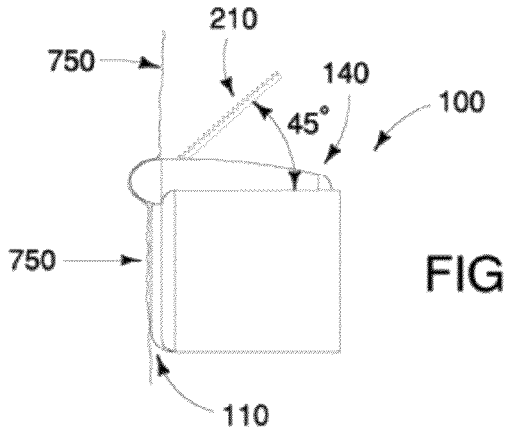
Figure 7C:
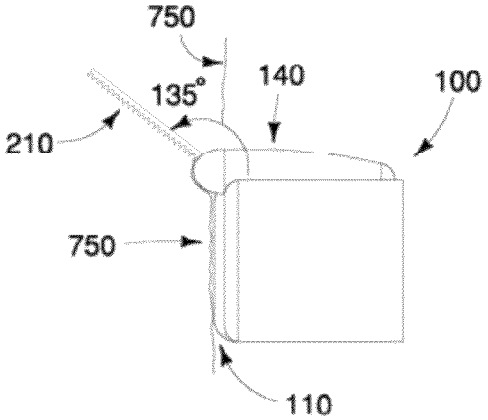
Figure 7D:
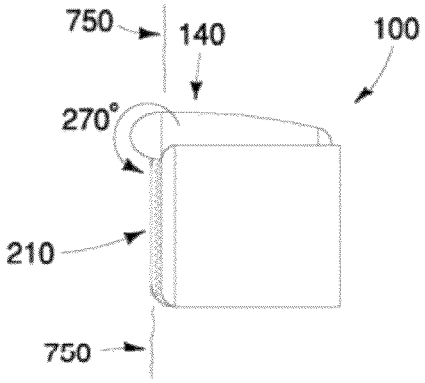

When actuated, the cutter arm 210 emerges from the pod 140 and pivots forward in an arc as shown in FIG. 7B. At the same time, the moveable blade 310 starts oscillating across the stationary blade 300. The moveable blade 310 is preferably oscillating at full cutting speed by the time the linear cutter arm 210 is at a 135 degree angle with respect to the length of the UUV 100 as shown in FIG. 7C. In this disclosed embodiment, the moveable blade 310 has a full cutting speed of preferably 10 Hz. The cutting speed can vary depending on the type of net 750 or object encountered.

At step 650, the linear cutting assembly 200 continues to move through its arc path and penetrates the fishing net 750 or object using the shearing action caused by the reciprocating teeth 340 and 350 (FIG. 3). FIG. 7D shows the linear cutter arm 210 at a 270 degree angle with respect to the longitude of the UUV 100. The present inventors have discovered that holding the net 750 or other object away from the front face 102 of the UUV 100 by the cutter guides 110 facilitates quicker and easier cutting of the net 750. The moveable blade 310 moves continuously back and forth at full cutting speed for a predetermined length of time, preferably 4-8 seconds depending on the type of net encountered. Alternatively, the offset cam 400 (FIG. 4A) that causes the moveable blade 310 to oscillate back and forth may rotate for a predetermined number of revolutions or according to another suitable parameter specified by the control software.

The linear cutter arm 210 returns back to its docked position inside the pod 140 at step 660 (as shown in FIG. 7A) and the method returns to step 600 to wait for the next speed signal from the UUV 100. UUV 100 continues with its mission after passing through net 750.

The length of time that the moveable blade 310 is oscillating at full cutting speed at step 650 may not be sufficient for UUV 100 to penetrate net 750 in one cutting sequence. When the next speed signal at step 600 indicates that UUV 100 is still traveling below the threshold speed at step 610 and below the cutting activation threshold speed at step 630, the linear cutter arm 210 will be deployed again at step 640. The linear cutting assembly 200 will repeatedly deploy the linear cutter arm 210 until the UUV 100 penetrates through the net 750 and resumes traveling at a speed above the cutting activation threshold speed. Optionally, the control software can set a maximum number of deployments for a given time period.

In this embodiment, the pod 140 is attached to the top, forward end 101 of the UUV 100 such that the linear cutter arm 210 will cut a vertical slit through the net 750 or object when the cutter arm 210 pivots along an arc up to 270 degrees. The size of the vertical slit is based on the length of the linear cutting arm 210 and can be increased by extending the length of the linear cutting arm 210. As shown in FIG. 7D, the length of the linear cutter arm 210 is preferably long enough for it to extend the entire diameter of UUV 100. Instead of cutting a vertical slit, other slit directions can be cut by attaching the pod 140 to UUV 100 at other positions outside the hull. Optionally, multiple pods 140 can be attached around the outside of UUV 100 for cutting multiple slits. In addition, although the linear cutting arm 210 has been described as moving 270 degrees in an arc, the range of movement can vary, however, from approximately 225 degrees to 290 degrees, based on user preferences.

The foregoing merely illustrates the principles of the linear cutting assembly. It will thus be appreciated that those skilled in the art will be able to devise numerous alternative arrangements that, while not shown or described herein, embody the principles of the invention and thus are within its spirit and scope. For example, the linear cutting assembly can use a crankshaft system, instead of a cam assembly as shown in the illustrative embodiments, to transform the rotational motion from a motor into the reciprocating linear motion of a blade. In addition, those skilled in the art will be able to scale the pod and linear cutting assembly to enable them to be used on a variety of other classes of UUVs and other underwater vehicles, marine vessels, and non-marine systems. For example, although the illustrative embodiments of the pod and linear cutting assembly are described for use on UUVs having an approximate diameter of 12.75 inches, the embodiments may be linearly scaled to work with UUVs ranging in size from the 7.5 inch diameter man-portable up to the heavy weight 21 inch diameter UUV class. And, it is possible for alternative embodiments to attach more than one pod to provide extra clearance for marine vessels and underwater vehicles with unusually large protrusions or diameters.

The disclosed embodiments of the linear cutting assembly described above may not be ideal for Large diameter Unmanned Underwater Vehicles (LUUVs) that require a much larger hole to be cut in a quick and efficient manner. The problem of penetrating through nets and other objects by LUUVs is solved by cutting the object using a combination cutting module. The combination cutting module includes multiple linear cutting assemblies and a concentric cutting assembly such as described in U.S. patent application Ser. No. 12/497,285, filed on Jul. 2, 2009, entitled "Concentric Cutting Assembly, Concentric Cutting System, and Net Penetration Method," the subject matter of which is incorporated in its entirety by reference herein. The concentric cutting assembly cuts the object using a rotatable cutter with floating teeth that rotates concentrically about a non-rotatable cutter with fixed teeth. The combined severing actions of the multiple linear cutting assemblies and the concentric cutting assembly will cut a sufficiently large opening in the object to allow a LUUV to pass through.

Figure 8:
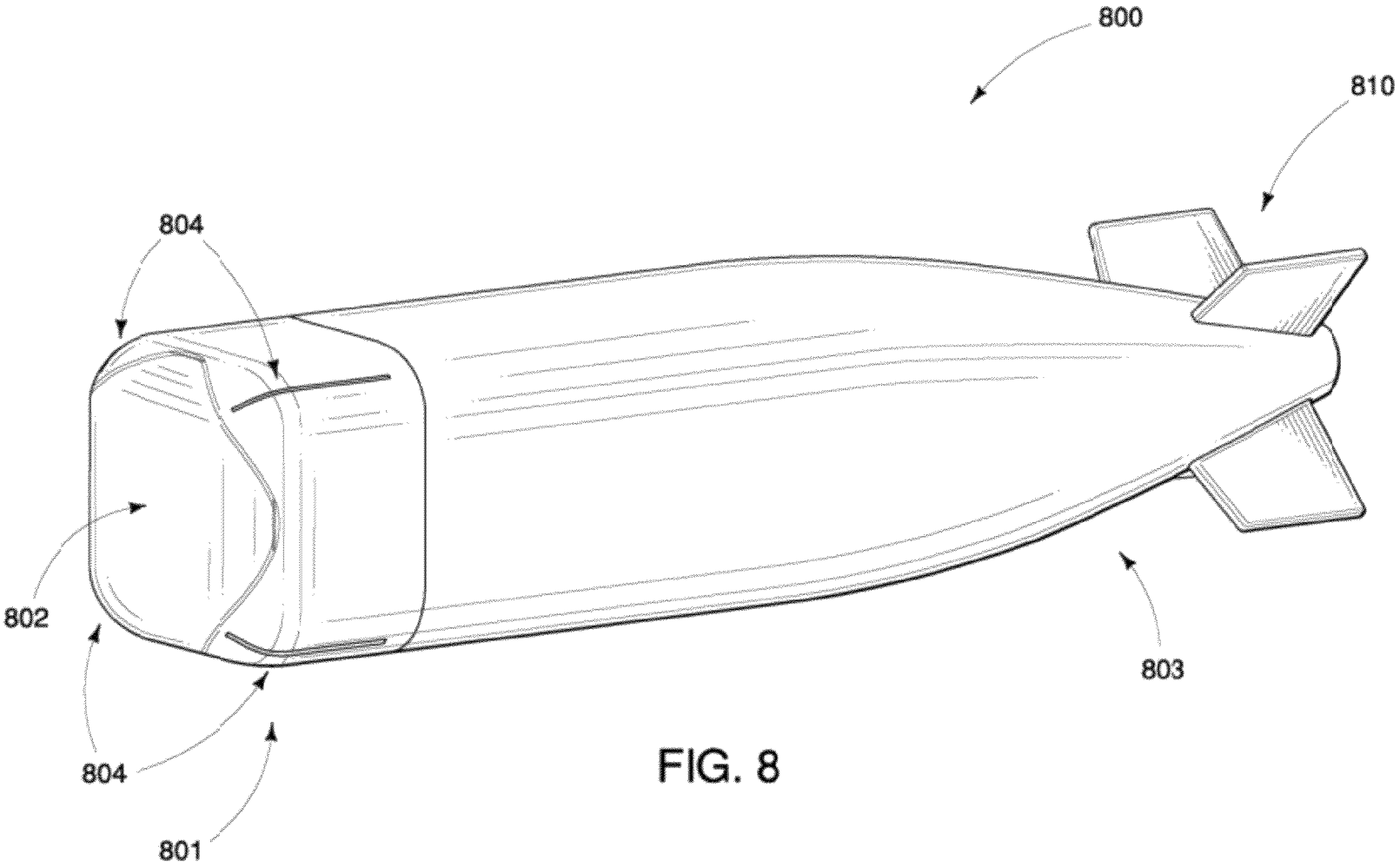
FIG. 8 is a diagram of a LUUV system in accordance with an embodiment described herein.
Figure 9:
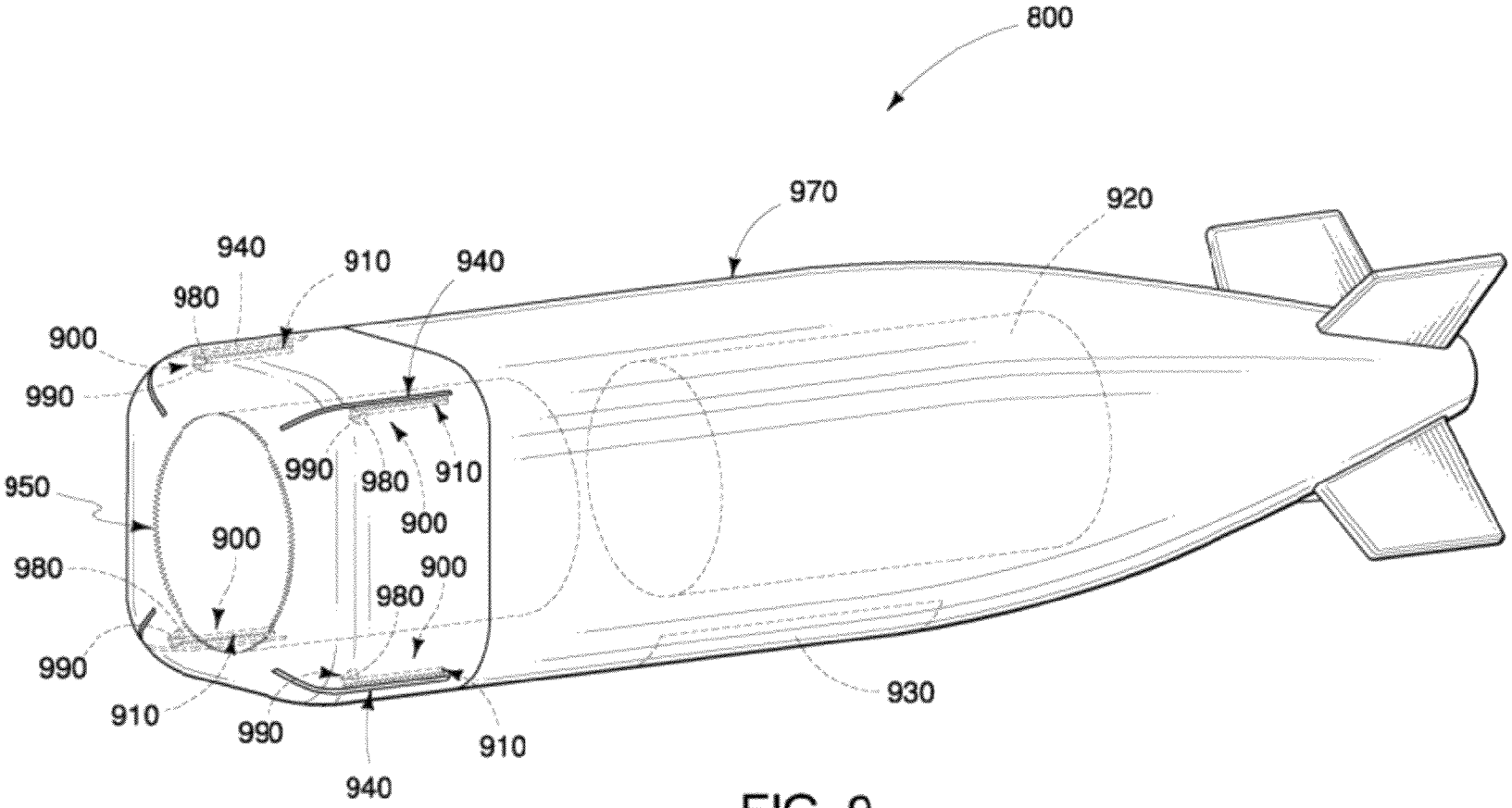
FIG. 9 illustrates the LUUV system of FIG. 8 having a concentric cutting assembly and linear cutting assemblies.

FIG. 8 shows a Large diameter Unmanned Underwater Vehicle (LUUV) system 800 in accordance with an embodiment described herein. The LUUV 800 may have a 50 inch diameter and a square shaped front face 802 with rounded corners 804. LUUV 800 is integrated with a concentric cutting assembly 950 at the forward end 801 and a propulsor 810 at the aft end 803. Installed in each of the four corners 804 of LUUV 800 is a linear cutting assembly 900 similar to linear cutting assembly 200. FIG. 9 illustrates the positions of the concentric cutting assembly 950 and four linear cutting assemblies 900 inside the LUUV 800. The differences between linear cutting assemblies 900 and 200 are explained below.

Linear cutting assembly 900 is not housed in a housing structure such as the pod 140. As shown in FIG. 9, there is sufficient space for a linear cutting assembly 900 inside each corner 804 of LUUV 800. Attached to the base plate 990 of linear cutting assembly 900 are sidewalls 980 that fasten to the inside of the hull 970. At each rounded corner 804 of front face 802 is a long slit 940 through which a linear cutter arm 910 emerges from within the hull 970 of LUUV 800. The length of the linear cutter arm 910 and the length and the start and end points of the slit 940 will vary depending on the range of motion desired for the linear cutter arm 910. Similar to the motion of linear cutter arm 210, the linear cutter arm 910 preferably moves in an arc of at least 225 degrees about a pivot point in the linear cutting assembly 900.

Cutting assemblies 900 and 950 require a power source and a net detection signal (which can be indirectly inferred from a speed signal as described above) to operate. Both the power source and the net detection signal can be supplied by or be provided completely independent of LUUV 800. Under the main pressure vessel 920 of LUUV 800 is a modular payload bay 930 storing sensors, a control processor for controlling the LUUV 800 and the cutting assemblies 900 and 950, a memory for storing control software and an I/O processor. The control processor is the main processor for LUUV 800 and will run the control software for the cutting assemblies 900 and 950. It shall be appreciated that the modular payload bay 930 can be located anywhere in the LUUV 800, including inside the main pressure vessel 920.

Figure 10:
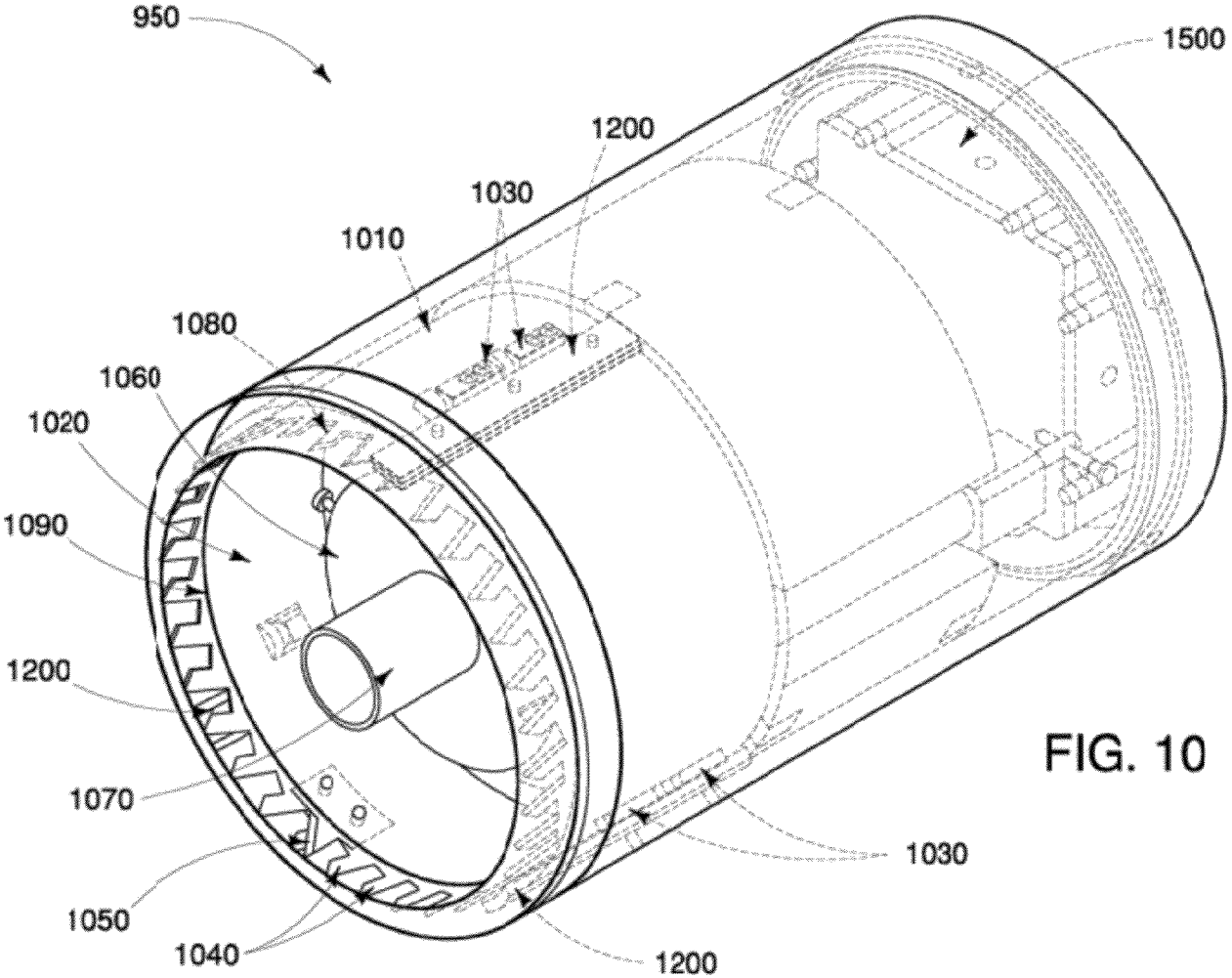
FIG. 10 is an internal view showing the components of a concentric cutting assembly in accordance with an embodiment described herein.

FIG. 10 is an internal view showing the components of the concentric cutting assembly 950 in accordance with the embodiment depicted in FIGS. 8 and 9. Concentric cutting assembly 950 includes two concentric cutters: non-rotatable cutter 1080 and rotatable cutter 1090. The forward end 801 of LUUV 800 has a 50 inch wide square front face 802 and can accommodate a non-rotatable cutter 1080 having a diameter up to 50 inches. Non-rotatable cutter 1080 comprises outer cylinder 1010 and fixed teeth 1040. Rotatable cutter 1090 comprises inner cylinder 1020 and floating teeth 1050.

Slide rails 1200 are attached to the inside of LUUV housing 970 as shown in FIG. 10. Concentric cutters 1080 and 1090 move back and forth along slide rails 1200. Concentric cutters 1080 and 1090 move forward along slide rails 1200 to engage and cut fishing nets and other objects encountered by LUUV 800 during a mission. After the object is cut, concentric cutters 1080 and 1090 retract along slide rails 1200 into their original position inside UUV housing 970. Three slide rails 1200 are used in the example embodiment of FIG. 10. If desired, particular embodiments may optionally include only two slide rails, more than three slide rails, or any other means for extending and retracting concentric cutters 1080 and 1090. Those skilled in the art will appreciate that alternative embodiments may employ roller bearings instead of slide rails. The roller bearings can be contained within slots to prevent rotation of non-rotatable cutter 1080.

Outer cylinder 1010 is mounted on slide rails 1200. Inner cylinder 1020 rotates concentrically within outer cylinder 1010. Six bearing plates 1030 are mounted to outer cylinder 1010 (four of which are visible in FIG. 10). Bearing plates 1030 serve two main purposes: (1) to keep concentric cylinders 1010 and 1020 axially aligned and (2) to keep the floating teeth 1050 in constant contact with the fixed teeth 1040. Each bearing plate 1030 can be adjusted in depth and tilt. If desired, particular embodiments may optionally mount bearing plates 1030 to inner cylinder 1020. Any desired number of bearing plates may optionally be used, however, the present inventors have found that six bearing plates are effective in axially aligning concentric cylinders 1010 and 1020.

Concentric cylinders 1010 and 1020 of the disclosed embodiment are made of carbon fiber. However, cylinders 1010 and 1020 can be made of any other material with properties similar to carbon fiber, such as, for example, titanium, stainless steel and carbon steel. The present inventors have found that carbon fiber is sufficiently strong to be used for penetrating nets and other objects and can be easily fabricated.

As shown in FIG. 10, outer cylinder 1010 can be formed with fixed teeth 1040 protruding from one end in a direction parallel to the center axis of outer cylinder 1010. Fixed teeth 1040 are each formed as blades having substantially the same angled cutting edge as each other. According to the embodiment of FIG. 10, one hundred fifty fixed teeth 1040 are evenly spaced about outer cylinder 1010. A cutting assembly embodying the principles of the invention can have any desired number of fixed teeth, however. Moreover, the fixed teeth can each have different shapes than shown, as is known in the art.

In accordance with an advantageous feature of the disclosed embodiment, three floating teeth 1050 are spring-mounted about one end of the outer surface of inner cylinder 1020, although any number of floating teeth 1050 can be spring-mounted. Similar to fixed teeth 1040, floating teeth 1050 are formed as blades and have substantially the same angled cutting edge as each other. Further, floating teeth 1050 extend from inner cylinder 1020 along the same direction as fixed teeth 1040 such that the blades of floating teeth 1050 are parallel to the blades of fixed teeth 1040.

In one embodiment, fixed teeth 1040 and floating teeth 1050 are fabricated from stainless steel. If desired, particular embodiments may optionally fabricate teeth from titanium, carbon steel, or any other metal with properties similar to stainless steel. The inventors found that galling can roughen the contact areas between fixed teeth 1040 and floating teeth 1050 after repeated use of the concentric cutting assembly 950. A lubricant may optionally be placed between the cutting surfaces to prevent material transferring from one surface to the other surface and to reduce friction. Alternatively, a cutting surface may be coated with a hardened material such as titanium nitride (TiN), titanium aluminum nitride (TiAN) or titanium carbon nitride (TiCN) to prevent material transfer. In addition, an anti-friction coating such as molybdenum sulfite (MoST) may be optionally placed over the hardened material to reduce friction.

If LUUV 800 does not have its own neutral buoyancy mechanism, particular embodiments may optionally include foam 1060 for neutral buoyancy. Foam 1060 can be positioned in the center of inner cylinder 1020 around center pipe 1070. If desired, foam 1060 can alternatively be positioned in the rear of concentric cutting assembly 950 if LUUV 800 has a forward looking sonar located in the center of inner cylinder 1020.

In accordance with an advantageous feature of this disclosed embodiment, the concentric cutting assembly 950 and the multiple linear cutting assemblies 900 integrate seamlessly within LUUV housing 970. Seamless integration of the cutting assemblies 950 and 900 has the effect of minimizing drag as LUUV 800 moves underwater.

Figure 11:
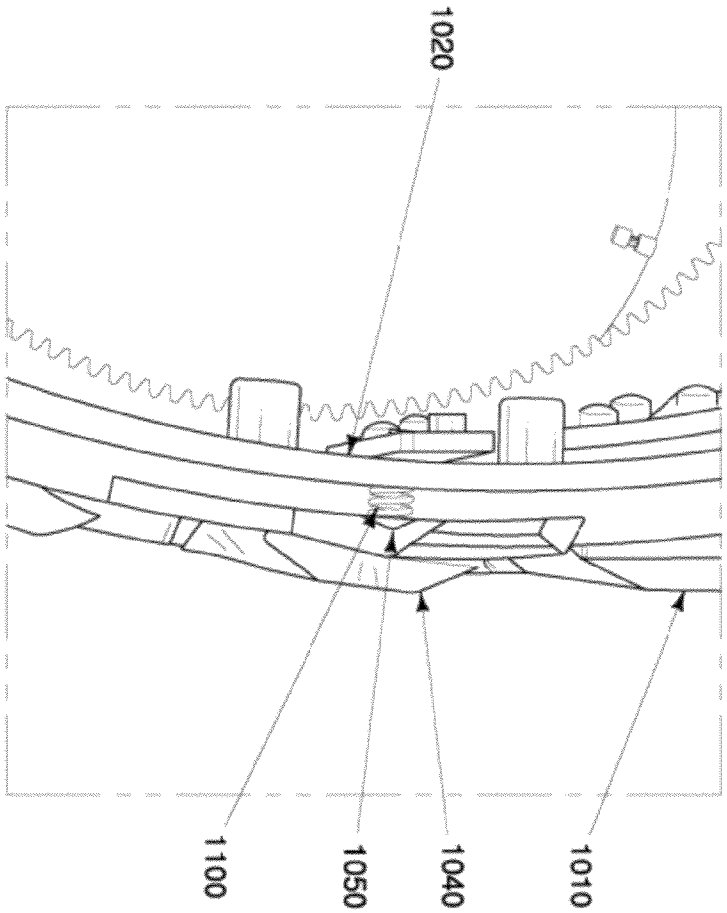
FIG. 11 is a profile view of a concentric cutting assembly in accordance with an embodiment described herein.

FIG. 11 is a profile view of concentric cutting assembly 950 in accordance with the embodiment disclosed in FIG. 10. Floating teeth 1050 are mounted to inner cylinder 1020 using low profile springs 1100. Wavy springs can be used to keep the cutting assembly profile narrow. The inventors have found that mounting floating teeth 1050 to inner cylinder 1020 using springs 1100 provide three main benefits. First, springs 1100 keep the cutting surfaces formed by floating teeth 1050 and fixed teeth 1040 tightly together. Tight cutting surfaces facilitate quick and efficient cutting of nets and other objects. Second, springs 1100 keep cylinders 1010 and 1020 tightly against each other. Third, spring-mounted floating teeth 1050 act like another set of bearings to keep concentric cylinders 1010 and 1020 evenly apart and axially aligned.

It will be appreciated that the size and shape of floating teeth 1050 and fixed teeth 1040 are not limited to the examples depicted in FIGS. 10 and 11. In fact, any size and shape of floating teeth 1050 and fixed teeth 1040 can be used so long as each floating tooth 1050 creates a shearing action when sliding against fixed teeth 1040. Preferably, the blades of fixed teeth 1040 have the same or substantially the same cutting angle. The present inventors have found that blades with a 30 to 70 degree angle, preferably a 55 degree angle, are effective at cutting nets and other objects. It will be appreciated that the cutting angle may need to be adjusted based on the objects to be penetrated and can be changed to any angle desired. For instance, blades with wide cutting angles are more effective at cutting through thick fishing nets than blades with narrower cutting angles. Moreover, the shearing action is more effective if the cutting surface consists of the entire edge of the blade. The present inventors have also discovered that fixed teeth 1040 with rounded tips have the advantageous features of capturing and holding the net in place while also preventing the rounded tips from catching on the net itself as rotatable cutter 1090 rotates to cut the object. In contrast, floating teeth 1050 preferably have pointed tips for more effective cutting.

Another advantageous feature of the disclosed embodiment is that rotatable cutter 1090 is free floating—supported only by means that keep it axially aligned with non-rotatable cutter 1080. In the example embodiment depicted in FIGS. 10 and 11, non-rotatable cutter 1080 is cylindrical, however, it will be appreciated that rotatable cutter 1090 may be shaped other than as a cylinder. If desired, particular embodiments may optionally include a rotatable cutter shaped as an equilateral triangle, square, Y-shaped, pentagon, or any other shape so long as the rotatable cutter can rotate concentrically within non-rotatable cutter 1080 and be mounted with at least one floating tooth.

If desired, non-rotatable cutter 1080 can have a non-cylindrical shape in systems in which the non-rotatable cutter does not have to conform to the shape of the LUUV system 800. In an alternative embodiment, for example, the concentric cutters can be comprised of two concentric equilateral triangles in which one, two, or three floating teeth are mounted to a respective corner of the rotatable triangular cutter, and bearing plates are aligned with the floating teeth for axially aligning the concentric cutters. It will be appreciated by those skilled in the art that a rotatable cutter embodying the principles of the invention can be any shape as long as it can rotate concentrically about a non-rotatable cutter and has floating teeth that are kept tightly against fixed teeth attached to the non-rotatable cutter.

Rotatable cutter 1090 can rotate clockwise or counter clockwise continuously or intermittently in one direction. Those skilled in the art will appreciate that the direction of rotation does not matter as long as floating teeth 1050 slide against fixed teeth 1040 to create a shearing action that cuts fishing nets and other objects. In an alternative embodiment, rotatable cutter 1090 can be configured to rotate continuously or intermittently in both directions. For instance, rotatable cutter 1090 can alternate rotating clockwise and counter clockwise for a pre-determined time period.

Figure 12:
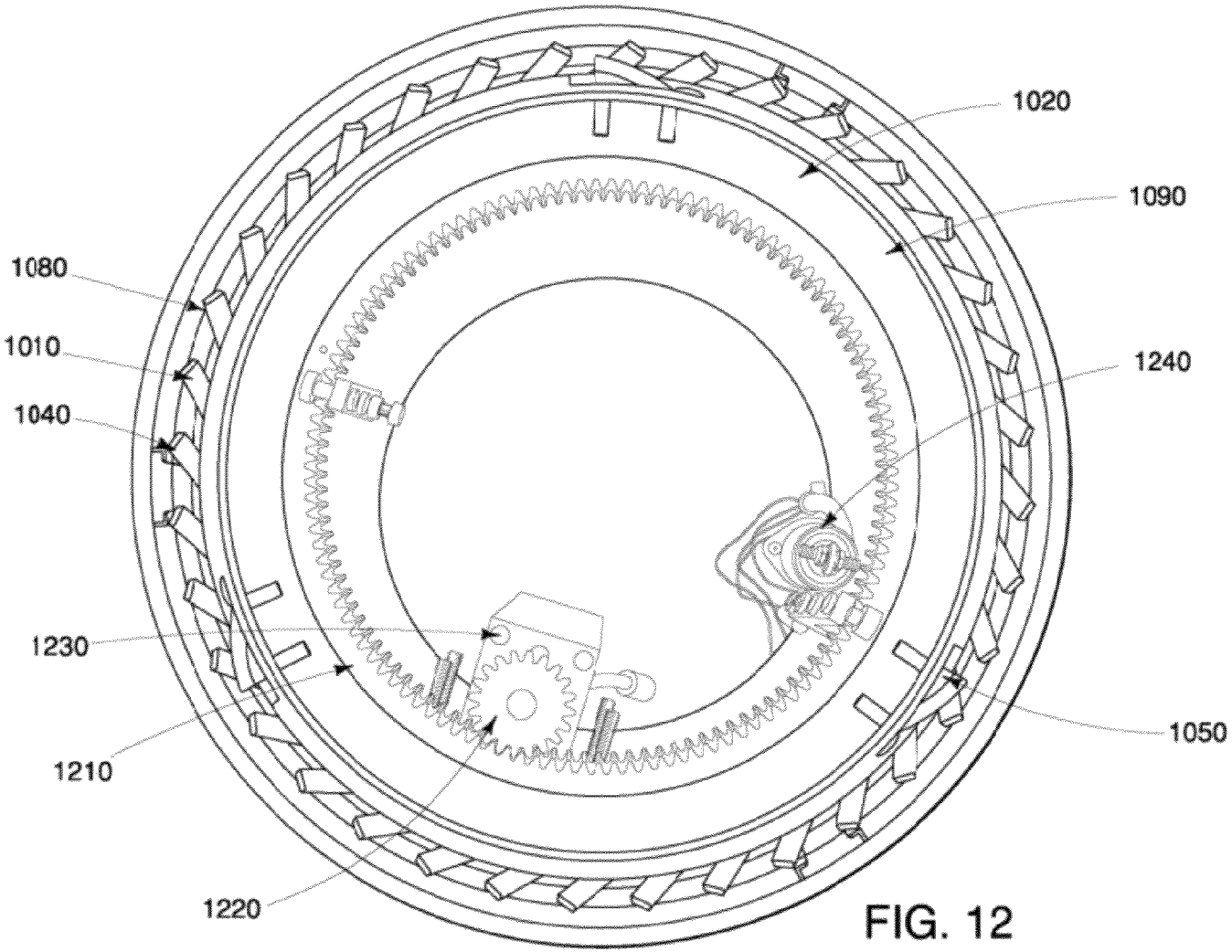
FIG. 12 shows an inside view of a concentric cutting assembly in accordance with an embodiment described herein.

FIG. 12 shows an inside view of concentric cutting assembly 950 in accordance with an embodiment described herein. A motor system housed within motor housing 1230 provides the means to rotate inner cylinder 1020. The motor system may be a brushed motor equipped with a planetary gearhead. By mounting motor housing 1230 to outer cylinder 1010, rotatable cutter 1090 can start rotating at any position with respect to non-rotatable cutter 1080 and gain momentum before concentric cutting assembly 950 contacts an object. Spur gear 1220 is mounted to the output shaft of the planetary gearhead and mates with internal ring gear 1210, which is mounted to inner cylinder 1020. If desired, particular embodiments may optionally include multiple motors instead of a single motor mounted radially about the outer cylinder 1010.

Actuator 1240 moves concentric cutters 1080 and 1090 forward through LUUV housing 970 to penetrate nets and other objects and retracts concentric cutters 1080 and 1090 after penetration. Actuator 1240 may have a stroke length of 3" and can move from fully retracted to fully extended in 1.5 seconds and provide up to 50 lbs of actuation force to outer cylinder 1010. One contact point of actuator 1240 is mounted to outer cylinder 1010 while the other contact point of actuator 1240 is mounted on the inside of LUUV housing 970 as shown in FIG. 12. If desired, particular embodiments may optionally include multiple actuators without significantly increasing the profile or thickness of concentric cutting assembly 950. The multiple actuators can be placed radially about outer cylinder 1010 and LUUV housing 970.

Figure 13:
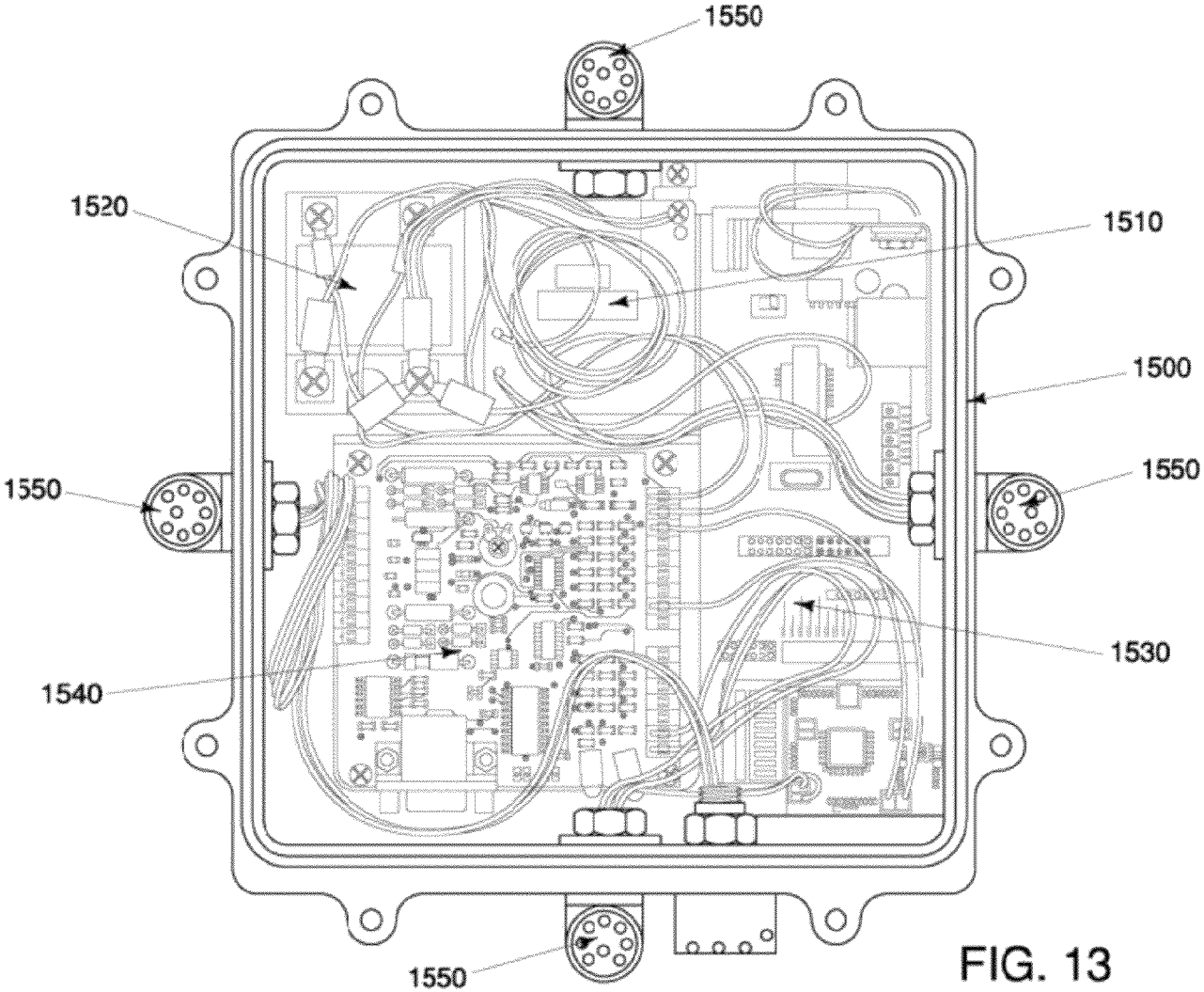
FIG. 13 is a schematic diagram of an electronic assembly of a concentric cutting assembly in accordance with an embodiment described herein.

FIG. 13 is a schematic diagram of an electronic assembly of concentric cutting assembly 950 in accordance with an embodiment described herein. Power is required to run the electronics housed in electronics housing 1500. Concentric cutting assembly 950 can be configured to utilize the battery typically used by the power propulsor 810 of the LUUV 800 to power its own electronics. Electronics housing 1500 contains microcontroller 1530, DC-DC converter 1510, motor relay 1520 and actuator controller 1540. As shown in FIGS. 9 and 10, LUUV housing 970 has a recess at the rear of concentric cutting assembly 950. This recess is deep enough to fit electronics housing 1500.

Microcontroller 1530 receives signals from the control processor of LUUV 800 to control concentric cutting assembly 950 functions including setting a cutter deployment speed for the speed at which concentric cutters 1080 and 1090 are deployed, a cutter run time for the length of time that rotatable cutter 1090 rotates at full speed, and a cutter retrieval time for the length of time it takes to retract concentric cutters 1080 and 1090 after cutting.

Preferably, components such as motor housing 1230, actuator 1240 (FIG. 12) and electronics housing 1500 are made waterproof. In this disclosed embodiment, actuator 1240 is waterproofed using a silicone rubber boot. Further, motor housing 1230 is machined from PVC with a double "O" ring shaft seal. All housing joints are double sealed to protect against water infiltration. Surrounding electronics housing 1500 are four waterproof connectors 1550. One waterproof connector is located on each side of electronics housing 1500.

Figure 14:
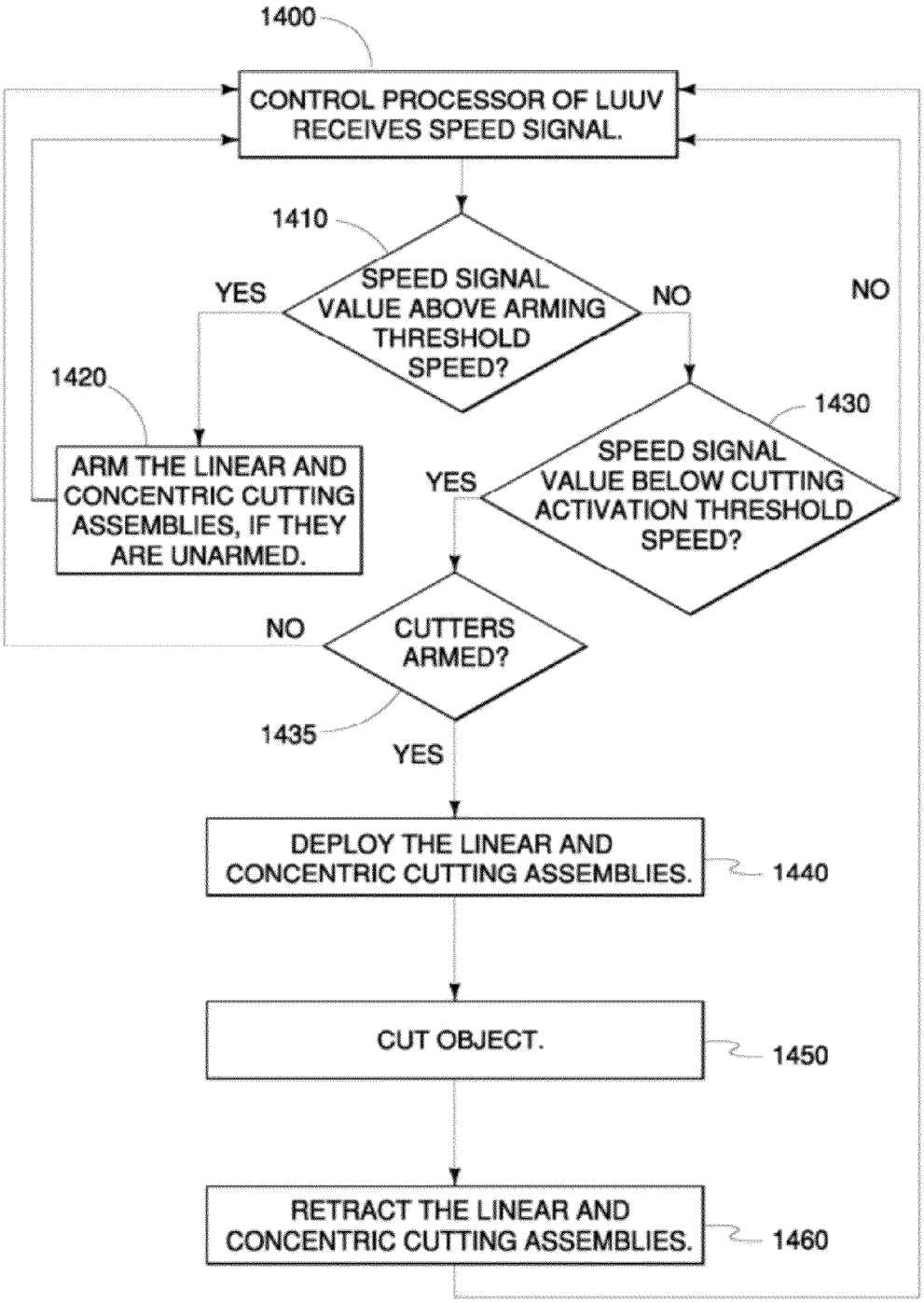
FIG. 14 is a flow chart of a method for penetrating through a net using a combination cutting module in accordance with an embodiment described herein.

FIG. 14 is a flow chart of a method for penetrating through a fishing net using the combined cutting assemblies 900 and 950 of LUUV 800. At step 1400, the control processor of LUUV 800 waits for a speed signal from LUUV 800. It should be appreciated by those skilled in the art that the speed signal can be generated by LUUV 800 using any known method of speed detection such as those described above in connection with FIG. 6.

Figure 15A:
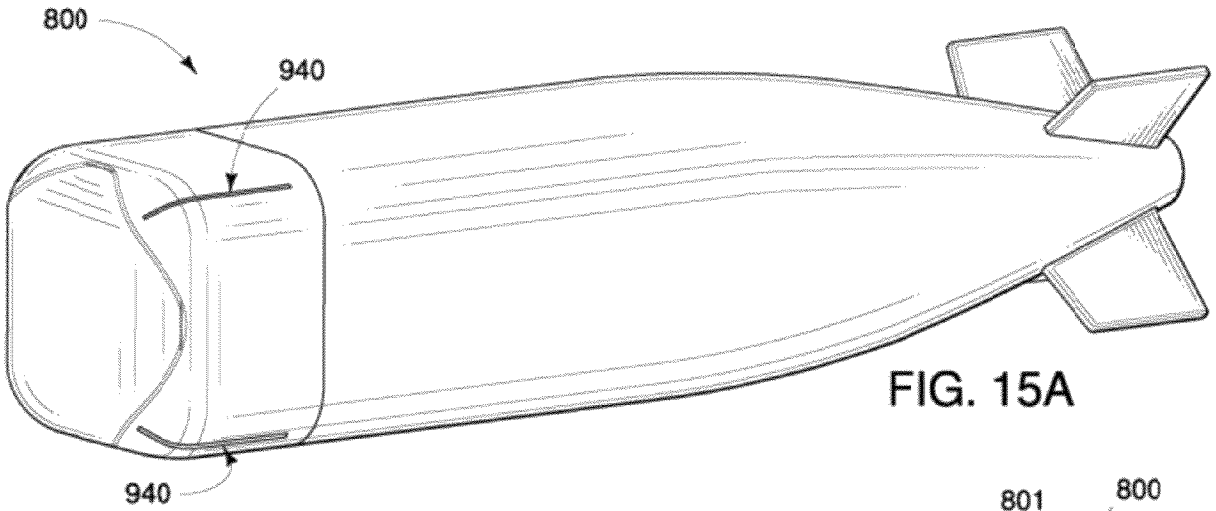
FIG. 15A illustrates cutting assemblies of a LUUV system in an armed state in accordance with an embodiment described herein.

According to one embodiment, LUUV 800 is configured to travel at 5.0 knots when carrying out a mission. An arming threshold speed can be set at any speed between 0 and 5 knots, preferably 3.5 knots, for the purpose of determining when to arm the cutting assemblies 900 and 950. Upon receiving a speed signal from LUUV 800, the control processor determines at step 1410 whether LUUV 800 is traveling at a speed above the arming threshold speed. The cutting assemblies 900 and 950 remain disarmed until LUUV 800 reaches the arming threshold speed of 3.5 knots. If the speed signal value is above the arming threshold speed, at step 1420, the control processor of LUUV 800 sends a control signal to arm the linear cutting assemblies 900 and sends a control signal to microcontroller 1530 to arm concentric cutting assembly 950, if they are not already armed. FIG. 15A illustrates the cutting assemblies 900 and 950 in an armed state. The concentric cutters 1080 and 1090 (FIG. 10) and linear cutter arms 910 (FIG. 9) are inside LUUV housing 970 (FIG. 9) when the cutting assemblies 900 and 950 are in the armed state. The method returns to step 1400 to wait for the next speed signal from LUUV 800. It should be appreciated by those skilled in the art that LUUV 800 can employ other methods to determine when to arm the linear cutting assemblies 900 and 950.

The same speed sensor used by LUUV 800 to measure its speed can also be used for object detection. For instance, when LUUV 800 comes into contact with an obstruction, its speed will decrease. Speed changes can be measured and provided to the control processor and microcontroller 1530 at predetermined time intervals, such as, every five seconds. A cutting activation threshold speed can be set for the purpose of determining when to deploy the cutting assemblies 900 and 950. It should be appreciated by those skilled in the art that LUUV 800 can employ any known method of object detection.

At step 1430, the control processor of LUUV 800 determines whether LUUV 800 is traveling at a speed below the cutting activation threshold speed of 3.0 knots. If LUUV 800 is traveling at a speed below the cutting activation threshold speed, the control processor determines whether the cutting assemblies 900 and 950 are armed at step 1435. The control processor sends a control signal to deploy the linear cutter arms 910 and sends a control signal to microcontroller 1530 to simultaneously deploy concentric cutters 1080 and 1090 at step 1440 if the cutting assemblies 900 and 950 are armed.

Figure 15B:
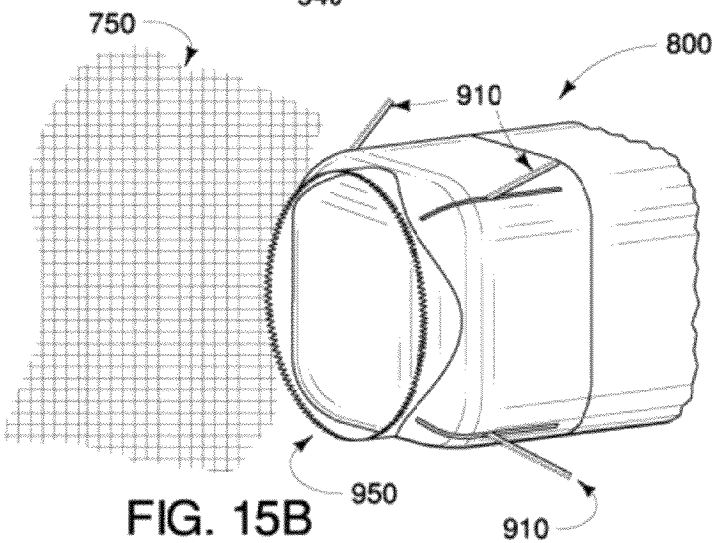
FIG. 15B illustrates cutting assemblies of a LUUV system in a deployed state in accordance with an embodiment described herein.
Figure 15C:
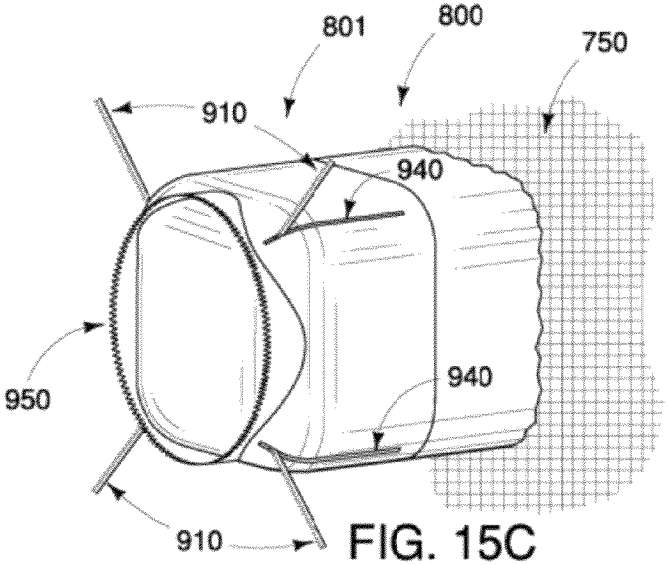
FIG. 15C illustrates cutting assemblies of a LUUV system cutting a fishing net or object in accordance with an embodiment described herein.

During deployment, concentric cutters 1080 and 1090 extend out of the forward end 801 of LUUV 800 as shown in FIG. 15B along slide rails 1200 (FIG. 10). At the same time, rotatable cutter 1090 starts rotating, preferably in a counter clockwise direction. Rotatable cutter 1090 is also preferably rotating at full cutting speed by the time non-rotatable cutter 1080 comes into contact with fishing net 750. In this disclosed embodiment, rotatable cutter 1090 has a full cutting speed of 100 revolutions per minute (RPM). When the four linear cutter arms 910 are simultaneously actuated, the cutter arms 910 emerge from the LUUV 800 through the respective slits 940 as shown in FIG. 15B and pivot forward in an arc as shown in FIG. 15C. At about the same time, the moveable blades of the linear cutter arms 910 start oscillating across the respective stationary blades of the linear cutter arms 910. The moveable blades of the linear cutter arms 910 are preferably oscillating at full cutting speed by the time the linear cutter arms 910 are at a 90 degree angle with respect to the length of the LUUV 800 as shown in FIG. 15C. In this disclosed embodiment, the moveable blades of the linear cutter arms 910 have a full cutting speed of preferably 10 Hz. The cutting speed can vary depending on the type of net 750 or object encountered.

Instead of simultaneously deploying the cutting assemblies 900 and 950, it will be appreciated by those skilled in the art that the control processor of LUUV 800 can send a control signal to deploy the linear cutter arms 910 simultaneously at step 1440 after a predetermined time period such as, for example, fifteen seconds after deploying the concentric cutters 1080 and 1090. Alternatively, the control software for LUUV 800 can automatically add a predetermined time delay between the deployment of each pair of linear cutting assemblies 900. For example, at step 640, the control software for LUUV 800 may deploy two opposing linear cutter arms 910 and then wait 10 seconds before deploying the other two opposing linear cutter arms 910.

Figure 16:
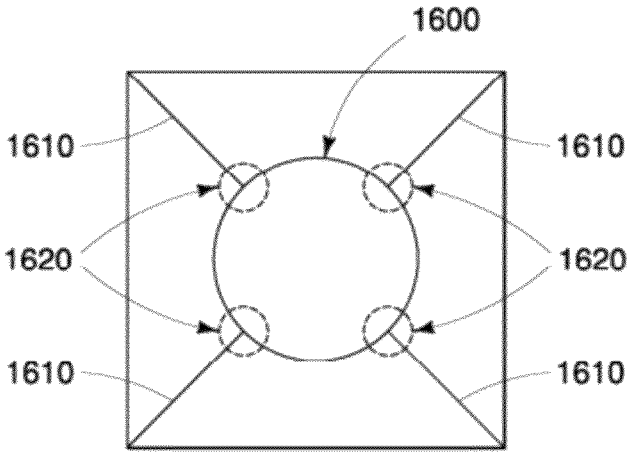
FIG. 16 illustrates cuts made by the cutting assemblies of a LUUV system in accordance with an embodiment described herein.

At step 1450, the LUUV 800 penetrates through fishing net 750. The net 750 first encounters the concentric cutters 1080 and 1090. Non-rotatable cutter 1080 of the concentric cutting assembly 950 captures and holds net 750 using at least one of the fixed teeth 1040. The present inventors have discovered that holding the net 750 or other object in place using non-rotatable cutter 1080 has two primary benefits. First, LUUV 800 is held still with respect to net 750. In other words, rotatable cutter 1090 will not cause LUUV 800 to rotate. Second, net 750 is held taut which facilitates quicker and easier cutting. Rotatable cutter 1090 rotates for a predetermined length of time, preferably 6 seconds. The length of time should be sufficient for LUUV 800 to cut a circular hole 1600 as shown in FIG. 16 using the shearing action caused by floating teeth 1050 sliding against fixed teeth 1040. It will be appreciated that the direction of rotation can be clockwise or counter clockwise so long as a shearing action results from the rotation.

The net 750 then stretches slightly, pulling back over the square front face 802 of LUUV 800 until it encounters the four linear cutter arms 910. As the linear cutter arms 910 swing forward in an arc, they cut linear slits 1610 in the net 750 as shown in FIG. 16. The moveable blades of the linear cutter arms 910 rotate continuously at full cutting speed for a predetermined length of time, preferably 8 seconds. Alternatively, the moveable blades of the linear cutter arms 910 may rotate for a predetermined number of revolutions or according to another suitable parameter specified by the control software. The cuts made by the linear cutter arms 910 and the concentric cutters 1080 and 1090 intersect 1620 as shown in FIG. 16. As the LUUV 800 passes through the net 750, the net 750 folds back along the cut slits 1610.

LUUV 800 continues with its mission after cutting the net 750. The linear cutter arms 910 swing backward in an arc to their starting positions inside the hull 970. The concentric cutters 1080 and 1090 retract inside the hull 970 along slide rails 1200 of LUUV 800. The method returns to step 1400 to wait for the next speed signal from the LUUV 800.

The length of time that the moveable blades of the linear cutter arms 910 are oscillating at full cutting speed may not be sufficient for LUUV 800 to penetrate net 750 in one cutting sequence. When the next speed signal at step 1400 indicates that LUUV 800 is still traveling below the arming threshold speed at step 1410 and below the cutting activation threshold speed at step 1430, the cutting assemblies 900 and 950 will be deployed again. The cutting assemblies 900 and 950 will repeatedly deploy the linear cutter arms 910 and concentric cutters 1080 and 1090, respectively, until the LUUV 800 penetrates through the net 750 and resumes traveling at a speed above the cutting activation threshold speed.

Alternatively, at step 1435, the control processor of LUUV 800 can additionally determine if the cutting sequence has repeated for a predetermined number of times within a predetermined period of time. If not, the cutting assemblies 900 and 950 may be deployed at step 1440. Otherwise, an error signal is recorded in the memory and communicated to an external device via a wireless communications link, for example. The control processor can wait a predetermined period of time before returning to step 1400.

Disclosed embodiments will simplify and add flexibility to UUV and LUUV mission planning and execution. UUV operation remains essentially unchanged until an object is detected. Once the object is detected, the concentric cutting assembly will engage the object, penetrate the object, and allow the UUV to carry out its mission with minimal loss of time. Disclosed embodiments allow a greater percentage of missions to be performed with a reduced risk of UUV loss or damage.

The foregoing merely illustrate the principles of the invention. For example, although the concentric cutters of the illustrative embodiments consist of a single non-rotatable cutter and a single rotatable cutter, it is possible for alternative embodiments to incorporate more than one stationary cutter and more than one rotating cutter. In addition, although the floating teeth and the linear cutting teeth of the illustrative embodiment have a certain shape, other shapes, materials and configurations are possible. Although the LUUV described above has a square shaped front face with rounded corners, it will be appreciated by those skilled in the art that the LUUV can have other shapes. For example, the LUUV can be round shaped, in which case, the linear cutting assemblies would be placed outside the LUUV in streamlined pods similar to pod 140 shown in FIG. 1.

Although the invention may be used to particular advantage in the context of LUUVs, those skilled in the art will be able to incorporate the invention into other underwater vehicles and marine vessels. Those skilled in the art will be able to incorporate the invention into non-marine systems such as, for example, unmanned land vehicles (e.g., cut through vegetation and barbed wires), unmanned robots and other remote vehicles (e.g., space applications). It will thus be appreciated that those skilled in the art will be able to devise numerous alternative arrangements that, while not shown or described herein, embody the principles of the invention and thus are within its spirit and scope.

The invention claimed is:

1. A cutting apparatus for an underwater vehicle comprising a housing structure attached at a forward end of the underwater vehicle, the housing structure containing a cutting unit wherein the cutting unit comprises an elongated opening on a surface of the housing structure to enable a cutter arm to rotate out of the housing structure in a forward arc, and wherein the cutter arm comprises a first blade configured to rotate about a drive shaft and a second blade parallel to the first blade and capable of moving linearly back and forth across the first blade, the first and second blades having substantially the same length and a plurality of reciprocating teeth; and the cutting unit further comprises an assembly for moving the second blade linearly back and forth across the first blade and for rotating the cutter arm in a forward arc about the drive shaft, wherein the cutter arm is able to rotate at least 225 degrees about the drive shaft.

2. A cutting apparatus for an underwater vehicle comprising a housing structure attached at a forward end of the underwater vehicle, the housing structure containing a cutting unit wherein the cutting unit comprises an elongated opening on a surface of the housing structure to enable a cutter arm to rotate out of the housing structure in a forward arc, and wherein the cutter arm comprises a first blade configured to rotate about a drive shaft and a second blade parallel to the first blade and capable of moving linearly back and forth across the first blade, the first and second blades having substantially the same length and a plurality of reciprocating teeth; and the cutting unit further comprises an assembly for moving the second blade linearly back and forth across the first blade and for rotating the cutter arm in a forward arc about the drive shaft, wherein the assembly for moving the second blade linearly back and forth across the first blade and for rotating the cutter arm comprise gears, a motor and a clutch assembly.

3. The cutting apparatus of claim 2, wherein the clutch assembly comprises a spring that pushes a clutch plate axially across a second shaft to control the rotation of the cutter arm.

4. The cutting apparatus of claim 2, wherein the assembly for moving the second blade linearly back and forth across the first blade and for rotating the cutter arm further comprise a cam assembly.

5. The cutting apparatus of claim 2, wherein the assembly for moving the second blade linearly back and forth across the first blade and for rotating the cutter arm further comprise a crankshaft assembly.

6. A cutting apparatus for an underwater vehicle comprising a housing structure attached at a forward end of the underwater vehicle, the housing structure containing a cutting unit wherein the cutting unit comprises an elongated opening on a surface of the housing structure, a cutter arm configured to rotate out of and/or into the housing structure in a forward and/or backward arc through the elongated opening, respectively, and a motor configured to operate a cutting motion of the cutter arm and rotate the cutter arm out of and/or into the housing structure.

7. The cutting apparatus of claim 6, wherein the housing structure has a front end and a back end, and is hydrodynamically shaped.

8. The cutting apparatus of claim 7, wherein a height of the housing structure decreases towards the back end.

9. The cutting apparatus of claim 7, wherein the front end of the housing structure is elliptical shaped.

10. The cutting apparatus of claim 6, wherein the housing structure is attached at the forward end on top of the underwater vehicle.

11. The cutting apparatus of claim 6, further comprising a plurality of housing structures equally spaced apart and attached to the forward end of the underwater vehicle, each housing structure including a cutting unit.

12. The cutting apparatus of claim 6, wherein the length of the cutter arm is equal to or greater than a diameter of the underwater vehicle.

13. The cutting apparatus of claim 6, further comprising an unmanned underwater vehicle outer hull, wherein the housing structure of the cutting apparatus is attached to an outside of the outer hull.

14. The cutting apparatus of claim 6, wherein the cutter arm comprises a first blade configured to rotate about a drive shaft while rotating out of and/or into the housing structure and a second blade parallel to the first blade and capable of moving linearly back and forth across the first blade, the first and second blades having a plurality of reciprocating teeth; and the cutting unit further comprises an assembly for moving the second blade linearly back and forth across the first blade and for rotating the cutter arm in a forward arc about the drive shaft.

15. The cutting apparatus of claim 14, wherein the cutter arm is able to rotate at least 225 degrees about the drive shaft.

16. The cutting apparatus of claim 14, wherein the assembly for moving the second blade linearly back and forth across the first blade and for rotating the cutter arm comprise gears, a motor and a clutch assembly.

17. The cutting apparatus of claim 16, wherein the clutch assembly comprises a spring that pushes a clutch plate axially across a second shaft to control the rotation of the cutter arm.

18. The cutting apparatus of claim 16, wherein the assembly for moving the second blade linearly back and forth across the first blade and for rotating the cutter arm further comprise a cam assembly.

19. The cutting apparatus of claim 16, wherein the assembly for moving the second blade linearly back and forth across the first blade and for rotating the cutter arm further comprise a crankshaft assembly.

20. The cutting apparatus of claim 14, wherein the first and second blades are located parallel to each other and in contact with each other.

21. The cutting apparatus of claim 20 wherein the first and second blades have corresponding slots and pegs for keeping the blades substantially against each other as the second blade moves linearly back and forth across the first blade.

22. The cutting apparatus of claim 14, wherein the reciprocating teeth are equally spaced apart.

23. A cutting apparatus for an underwater vehicle comprising a housing structure attached at a forward end of the underwater vehicle, and an unmanned underwater vehicle outer hull, wherein the housing structure of the cutting apparatus is attached to an outside of the outer hull, the housing structure containing a cutting unit wherein the cutting unit comprises an elongated opening on a surface of the housing structure to enable a cutter arm to rotate out of the housing structure in a forward arc, the cutting apparatus further comprising an outer hull front face having plural cutter guides spaced apart for keeping an object from contacting the front face of the vehicle.

24. The cutting apparatus of claim 23, wherein the cutter guides are acoustically transparent.

25. The cutting apparatus of claim 23, wherein the cutter arm is located between two adjacent cutter guides when the cutter arm rotates approximately 270 degrees.

26. A cutting apparatus for an underwater vehicle comprising a housing structure attached at a forward end of the underwater vehicle, and an unmanned underwater vehicle outer hull, wherein the housing structure of the cutting apparatus is attached to an outside of the outer hull, the housing structure containing a cutting unit wherein the cutting unit comprises an elongated opening on a surface of the housing structure to enable a cutter arm to rotate out of the housing structure in a forward arc, the cutting apparatus further comprising a control processor executing control software for controlling the assembly for moving the second blade linearly back and forth across the first blade and for rotating the cutter arm.

27. A method of penetrating an object by an underwater vehicle, the method comprising the steps of: providing an underwater vehicle having a housing structure attached to an outer hull of the underwater vehicle at a forward end thereof, the housing structure containing a cutting unit comprising an elongated opening on a surface of the housing structure, a cutter arm configured to rotate out of and/or into the housing structure in a forward and/or backward arc through the elongated opening, respectively, the cutter arm having a first blade configured to rotate about a drive shaft and a second blade in contact with and parallel to the first blade, and a motor configured to operate a cutting motion of the cutter arm and rotate the cutter arm out of and/or into the housing structure, deploying the linear cutting assembly such that the cutter arm rotates from an initial position within the housing structure in a forward arc and the second blade moves linearly back and forth across the first blade; cutting the object as the cutter arm contacts the object, the first and second blades having reciprocating teeth that cause a shearing action when the second blade moves linearly back and forth across the first blade; and retracting the cutter arm to the initial position.

28. The method of claim 27, further comprising a detecting step for detecting the object in a path of the underwater vehicle, wherein the detecting step includes determining whether the underwater vehicle is traveling at a speed below a cutting activation threshold speed.

29. The method of claim 27, further comprising determining whether the underwater vehicle is traveling at a speed above an arming threshold speed.

30. The method of claim 29, further comprising arming the cutting assembly when it is determined that the underwater vehicle is traveling at a speed above the arming threshold speed.

31. The method of claim 27, wherein the cutter arm retracts after the second blade moves linearly back and forth across the first blade for a predetermined time period.

32. The method of claim 27, wherein the cutter arm retracts after the second blade moves linearly back and forth across the first blade a predetermined number of times.

33. The method of claim 27, wherein the underwater vehicle further uses a concentric cutting assembly having dual concentric cutters, and the method further comprises the steps of: deploying the concentric cutting assembly such that the dual concentric cutters extend out from a forward end of the underwater vehicle; cutting the object using the dual concentric cutters and the linear cutter arm; and retracting the concentric cutting assembly.

* * * * *